US008256862B2

(12) United States Patent
Takagi et al.

(10) Patent No.: US 8,256,862 B2
(45) Date of Patent: Sep. 4, 2012

(54) FORMATION OF IMAGE BY IMAGE FORMING APPARATUS WITH OVERLAPPING AREA

(75) Inventors: Yasunobu Takagi, Kanagawa (JP); Yoshihisa Ohta, Tokyo (JP); Takashi Kimura, Kanagawa (JP); Taku Satoh, Kanagawa (JP); Makoto Tanaka, Tokyo (JP); Masakazu Yoshida, Kanagawa (JP); Shinichi Hatanaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 340 days.

(21) Appl. No.: 12/652,810

(22) Filed: Jan. 6, 2010

(65) Prior Publication Data

US 2010/0182366 A1 Jul. 22, 2010

(30) Foreign Application Priority Data

Jan. 16, 2009 (JP) ..... 2009-008049
Apr. 10, 2009 (JP) ..... 2009-096346
Nov. 20, 2009 (JP) ..... 2009-265320

(51) Int. Cl.
*B41J 29/38* (2006.01)

(52) U.S. Cl. ..... 347/14; 347/5; 347/13; 347/15

(58) Field of Classification Search ..... 347/5, 13, 347/14, 15, 40, 42, 44
See application file for complete search history.

(56) References Cited

U.S. PATENT DOCUMENTS 7,083,247 B2 8/2006 Yoshida et al.
7,237,871 B2 7/2007 Yamaguchi et al.
7,290,846 B2 11/2007 Takahashi
7,374,265 B2 5/2008 Yamane et al.
7,407,248 B2 8/2008 Hirano et al.
7,540,578 B2 6/2009 Suzuki et al.
7,570,392 B2 8/2009 Takahashi
7,576,886 B2 8/2009 Kimura
7,600,842 B2 10/2009 Hirano et al.
2002/0130922 A1* 9/2002 Okawa et al. ..... 347/37
2005/0122354 A1* 6/2005 Yamane et al. ..... 347/11
2006/0092206 A1 5/2006 Kimura et al.
2006/0098232 A1 5/2006 Nakano et al.
2007/0058201 A1 3/2007 Ike et al.
2007/0064031 A1 3/2007 Nakano et al.
2007/0091135 A1 4/2007 Hosaka et al.
2007/0106962 A1 5/2007 Sakakibara et al.
2007/0165068 A1* 7/2007 Tsuboi ..... 347/41
2007/0211092 A1 9/2007 Shingyohuchi et al.
2007/0216953 A1 9/2007 Kikuchi et al.
2007/0242098 A1* 10/2007 Sudo et al. ..... 347/40

(Continued)

FOREIGN PATENT DOCUMENTS

JP 10-278245 10/1998

(Continued)

*Primary Examiner* — Laura Martin
(74) *Attorney, Agent, or Firm* — IPUSA, PLLC

(57) ABSTRACT

A method of forming an image by an image forming apparatus provided with a print head having plural nozzles, wherein the print head has an overlapping area whose print area overlaps a print area of a physically adjacent print head, or has an overlapping area whose print area overlaps an adjacent scan line on a print sheet surface, includes an image forming step of forming an image by the print head, wherein the image forming step includes a control step of controlling in a variable manner an amount of ink sprayed from a proximity nozzle situated in close proximity of the overlapping area, the proximity nozzle being one of the nozzles situated in a non-overlapping area outside the overlapping area.

14 Claims, 30 Drawing Sheets

U.S. PATENT DOCUMENTS

| | | | |
|---|---|---|---|
| 2008/0231904 | A1 | 9/2008 | Suzuki et al. |
| 2009/0051734 | A1 | 2/2009 | Ike et al. |

FOREIGN PATENT DOCUMENTS

| | | |
|---|---|---|
| JP | 2004-268326 | 9/2004 |
| JP | 2004-345158 | 12/2004 |
| JP | 2005-161733 | 6/2005 |
| JP | 2005-169628 | 6/2005 |
| JP | 2005-205849 | 8/2005 |
| JP | 2006-087053 | 3/2006 |
| JP | 2006-240043 | 9/2006 |
| JP | 2006-315411 | 11/2006 |
| JP | 2007-008176 | 1/2007 |
| JP | 2007-015180 | 1/2007 |

* cited by examiner

LOW GRAYSCALE LEVEL | MIDDLE GRAYSCALE LEVEL | HIGH GRAYSCALE LEVEL

LOW GRAYSCALE LEVEL | MIDDLE GRAYSCALE LEVEL | HIGH GRAYSCALE LEVEL

LOW GRAYSCALE LEVEL | MIDDLE GRAYSCALE LEVEL | HIGH GRAYSCALE LEVEL

FORMATION OF IMAGE BY IMAGE FORMING APPARATUS WITH OVERLAPPING AREA

BACKGROUND OF THE INVENTION

1. Field of the Invention

The disclosures herein generally relate to an image forming method, an image forming apparatus, and an image forming program for forming an image by an inkjet method.

2. Description of the Related Art

An inkjet printing method has advantages such as high-speed printing, the ability to print on a normal paper sheet without requiring a special fusing process, and a small level of noise produced at the time of printing. Because of this, the inkjet printing method has been attracting attention for use in office. Various types of inkjet printing methods have been studied and put into practical use as commercial products. These inkjet printing methods use a print head that includes an ink liquid chamber and a nozzle communicating with the chamber. A pressure is applied to ink in the ink liquid chamber in response to image information or the like, so that an ink droplet is sprayed through the nozzle to be attached onto a print sheet such as a paper sheet or film to form an image.

An image forming apparatus (e.g., inkjet printer) using such an inkjet printing method can print on various types of print media because ink is sprayed from the print head to form an image in a non-contacting manner. Inkjet printers are classified mainly into a serial type and a line type.

The serial-type inkjet printer forms an image by moving a print head back and forth in a main scan direction perpendicular to a sheet travel direction (i.e., a sub-scan direction). The line-type inkjet printer has a print head fixedly arranged along the extension of a sheet width to form an image. The serial-type inkjet printer and the line-type inkjet printer have a common problem in that streaks or uneven appearance may appear.

A serial-type inkjet printer forms an image while moving a print sheet. As a result, a streak or uneven appearance may appear in the image at the boundary between adjacent scan lines due to various reasons such as sheet movement error, angular displacement of the print head, etc. There is also a serial-type inkjet printer in which a plurality of print heads is connected in series to provide an elongated print head for increasing a print speed. An inkjet printer having such an elongated print head may suffer the problem of a streak or uneven appearance at a boundary between print heads due to assembly error. The problem of a streak or uneven appearance caused by the error at the junction point between print heads is hard to solve because the assembly of the print heads fixes the positional relationships of the print heads, which makes it difficult to perform adjustment after assembly.

In a line-type inkjet printer, print heads are connected in series to provide a sufficient length to cover the width of a print sheet. In such a line-type inkjet printer, generally, the print heads are fixedly mounted, and perform one-path printing, which completes the formation of an image by a single scan of the heads. Accordingly, such measures as to reduce streaks through multiple scans of the heads cannot be adopted, so that the problem of streaks or uneven appearance is more pronounced.

In respect of the problem of a streak or uneven appearance at the seam line (i.e., one of the boundary between heads and the boundary between scan lines, which are essentially the same as a phenomenon appearing on a print sheet, and, thus, will not be discriminated from one another), there is a technology to reduce a streak or uneven appearance by providing nozzles overlapping each other. Nozzles situated at an end of a head is arranged to overlap nozzles of another head, and overlapping pixels are printed by a plurality of print heads, thereby reducing a streak or uneven appearance caused by density variation of the dots.

Japanese Patent Application Publication 2007-015180 discloses printing dots in the overlapping area selectively by the print heads in a staggered manner and also changes the dot size in the overlapping area in response to a displacement, thereby reducing streaks and uneven appearance. Japanese Patent Application Publication 2005-169628 discloses controlling the amount of ink ejected from the overlapping nozzles in response to information relating to the amount of ink printed in a predetermined area, thereby reducing streaks and uneven appearance.

The related-art technologies described above can reduce streaks or uneven appearance appearing in an image within the overlapping area, but have a problem in that a streak tends to conspicuously remain at the end of the overlapping area. When print heads are brought closer to each other in the sub-scan direction, for example, a black streak appears at the seam portion. The overlap processing as described can reduce the density variation of dots to lessen the black streak within the overlapping area. At the boarder between the overlapping area and the non-overlapping area, however, a high-dot-density portion is created, resulting in an area of high density being left to remain.

When print heads are taken apart from each other in the sub-scan direction, for example, a white streak appears at the seam portion. In this case, a low-dot-density portion is created at the border between the overlapping area and the non-overlapping area, resulting in an area of low density being left to remain. The related-art technologies previously described control ink ejection in the overlapping area. However, a main cause of a streak or uneven appearance resides at the border between the overlapping area and the non-overlapping area. Further, those related-art technologies are not based on simple processing configurations. Since several nozzles are used in the overlapping area, the control of the nozzles in the overlapping area results in an increase in processing load.

Accordingly, there is a need for an image forming method, an image forming apparatus, and an image forming program that can reduce a streak or the like appearing at the end of an overlapping area.

SUMMARY OF THE INVENTION

It is a general object of at least one embodiment of the present invention to provide an image forming method, an image forming apparatus and an image forming program that substantially obviates one or more problems caused by the limitations and disadvantages of the related art.

In one embodiment, a method of forming an image by an image forming apparatus provided with a print head having plural nozzles, wherein the print head has an overlapping area whose print area overlaps a print area of a physically adjacent print head, or has an overlapping area whose print area overlaps an adjacent scan line on a print sheet surface, includes an image forming step of forming an image by the print head, wherein the image forming step includes a control step of controlling in a variable manner an amount of ink sprayed from a proximity nozzle situated in close proximity of the overlapping area, the proximity nozzle being one of the nozzles situated in a non-overlapping area outside the overlapping area.

In one embodiment, an image forming apparatus includes a print head having plural nozzles, wherein the print head has an overlapping area whose print area overlaps a print area of a physically adjacent print head, or has an overlapping area whose print area overlaps an adjacent scan line on a print sheet surface, and a control unit configured to control in a variable manner an amount of ink sprayed from a proximity nozzle situated in close proximity of the overlapping area, the proximity nozzle being one of the nozzles situated in a non-overlapping area outside the overlapping area.

According to at least one embodiment, ink spraying from nozzles printing one or more raster lines in close proximity of the overlapping area is controlled to remove streaks or the like occurring at the end of print heads having the overlapping area.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

In the following, embodiments of the present invention will be described with reference to the accompanying drawings. An image forming method and program will also be described.

[First Embodiment]

<Hardware Configuration>

Figure 1:
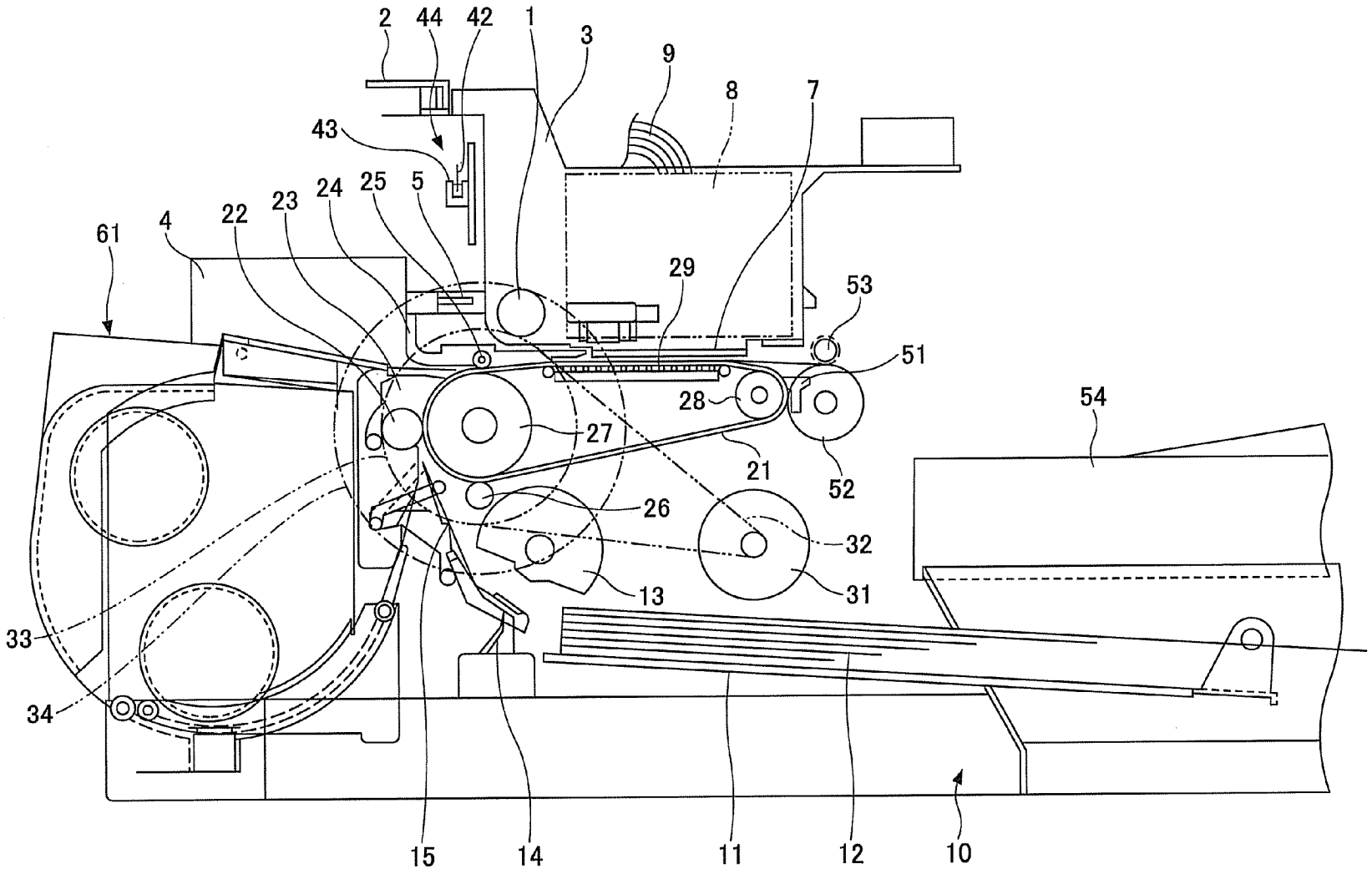
FIG. 1 is a lateral view of the configuration of an image forming apparatus according to an embodiment.
Figure 2:
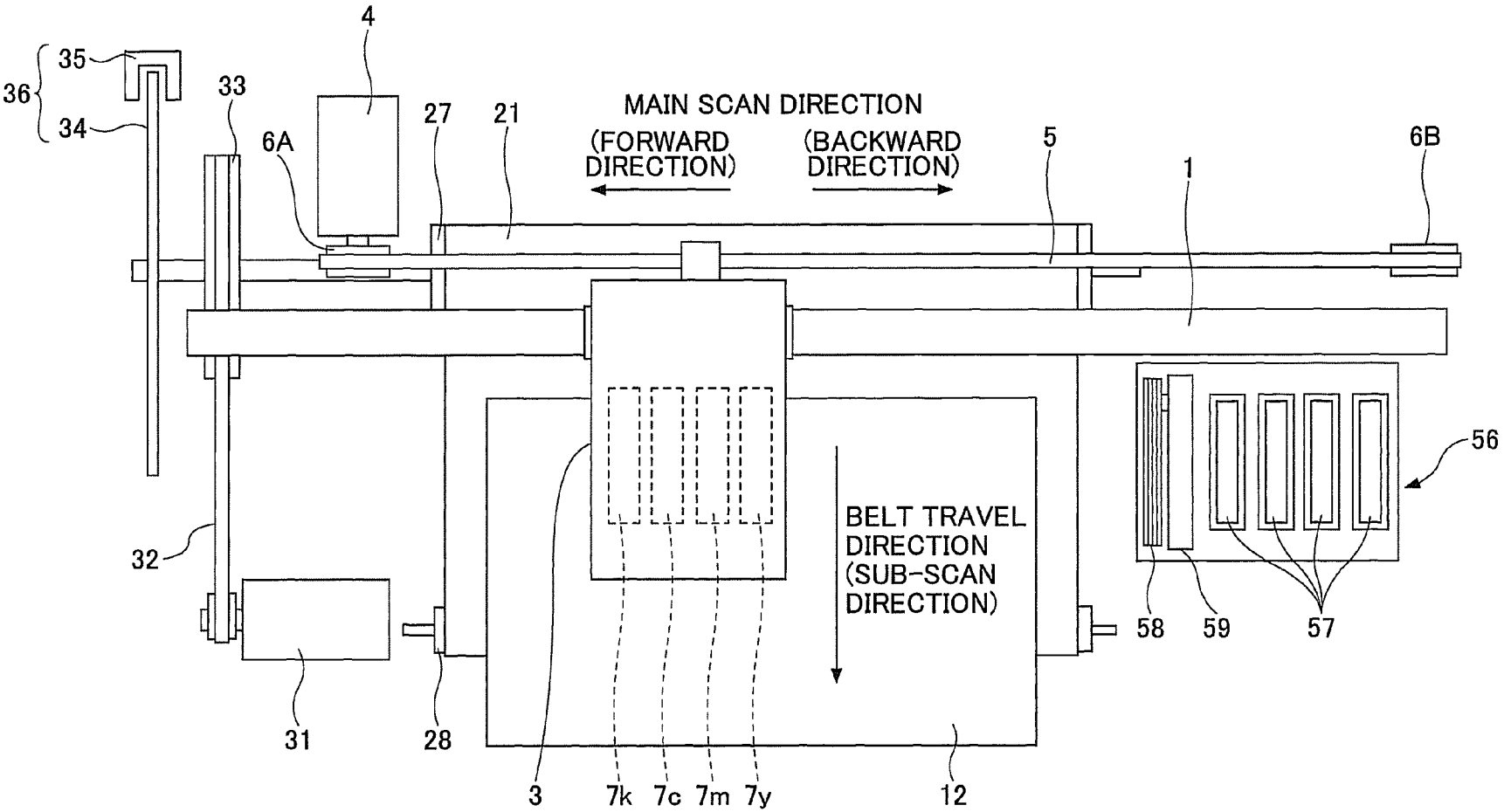
FIG. 2 is a plan view of the configuration of the image forming apparatus according to the embodiment.

FIG. 1 and FIG. 2 are drawing illustrating an example of an image forming apparatus. FIG. 1 is a lateral view of the entire configuration of a mechanical section of the image forming apparatus. FIG. 2 is a plane view of the mechanical section of the image forming apparatus. The image forming apparatus has a guide rod 1 and guide rail 2 serving as a guide member extending between side plates (not illustrated). The guide rod 1 together with the guide rail 2 keep a carriage 3 in place, such that the carriage 3 is movable in a main scan direction. The image forming apparatus performs a scan in a main scan direction indicated by an arrow in FIG. 2 by use of a main scan motor 4, which drives a timing belt 5 looped around a drive pulley 6A and a driven pulley 6B.

The carriage 3 has four print heads 7*y*, 7*c*, 7*m*, and 7*k* (which are referred to as a print head 7 when colors are not discriminated from each other), which include liquid spray heads for spraying ink droplets of yellow (Y), cyan (C), magenta (M), and black (K), respectively. Nozzle lines each comprised of a plurality of nozzles arranged in a sub-scan direction perpendicular to the main scan direction are placed in such a position to spray ink droplets downwardly. The carriage 3 is provided with sub-tanks 8 of respective colors for supplying the respective color inks to the print heads 7. The sub-tanks 8 receive inks for replenishment from main tanks (i.e., ink cartridges, not shown) through ink supply tubes 9.

A liquid spray head used as the print heads 7 may employ, as a pressure generating mechanism to generate a pressure to spray droplets, a piezoelectric actuator such as a piezoelectric element, a thermal actuator utilizing a phase change caused by liquid film boiling by use of an electricity-to-heat conversion element such as a heat generating resistor, a shape-memory alloy actuator utilizing a metal phase change caused by temperature change, and a static actuator utilizing an electrostatic force. The head configuration is not limited to the one in which the individual color heads are independent of each other. One or more head members (i.e., liquid spray heads) having nozzle lines comprised of nozzles for spraying droplets of different colors may be employed.

In the image forming apparatus and image forming method described herein, the term "distribution of print data" means distributing data to respective nozzles for generating print dots based on print data, and also means dividing and distributing data to respective scans in the case of a printing method that performs plural scans.

A crescent roller (i.e., paper feeder roller) 13 that feeds paper sheets 12 one by one from a paper sheet stack unit 11 and a separation pad 14 opposed to the crescent roller 13 are provided as a paper feeder unit for feeding paper sheets 12 placed on the paper sheet stack unit (i.e., pressure plate) of a paper feeder tray 10 or the like. The separation pad 14 is formed of a material having a large friction coefficient, and is urged against the crescent roller 13.

A conveyer unit to convey the paper sheets fed from the paper feeder unit under the print heads 7 includes a conveyer belt 21, a counter roller 22, a conveyer guide 23, and a roller 25. The conveyer belt 21 conveys the paper sheets 12 that are stuck thereon through an electrostatic force. The counter roller 22 conveys the paper sheets 12 sent from the paper feeder unit along a guide 15 by placing the paper sheets 12 between the counter roller 22 and the conveyer belt 21. The conveyer guide 23 causes the paper sheets 12 traveling substantially in a vertical direction to make an approximately 90-degree turn to follow the surface of conveyer belt 21. The roller 25 is urged against the conveyer belt 21 by an urging member 24. The conveyer unit also includes a charge roller 26 serving as a charge means to electrically charge the surface of the conveyer belt 21.

The conveyer belt 21 is a loop belt that is stretched between a conveyer roller 27 and a tension roller 28. The conveyer belt 21 rotates in a belt travel direction (i.e., sub-scan direction) illustrated in FIG. 2 by the rotation of the conveyer roller 27, which is driven by a sub-scan motor 31 through a timing belt 32 and a timing roller 33. A guide member 29 is disposed on the back-surface side of the conveyer belt 21 at the position where an image is formed by the print heads 7. The charge roller 26 is placed in contact with the surface of the conveyer belt 21 to rotate in accordance with the rotation of the conveyer belt 21.

As illustrated in FIG. 2, the shaft of the conveyer roller 27 has a slit disc 34 attached thereto. A sensor 35 is provided to detect the slits of the slit disc 34. The slit disc 34 and the sensor 35 together constitute a rotary encoder 36.

Further, a paper discharge unit is provided for the purpose of ejecting the paper sheets 12 on which printing is performed by the print heads 7. The paper discharge unit includes a separation nail for separating each paper sheet 12 from the conveyer belt 21, discharging rollers 52 and 53, and a paper discharge tray 54 on which the ejected paper sheets 12 are placed.

A duplex unit 61 is removably mounted on the back side of the apparatus. The duplex unit 61 receives a paper sheet 12 that is returned by reverse rotation of the conveyer belt 21, and flips over the sheet for provision to a gap between the counter roller 22 and the conveyer belt 21.

As illustrated in FIG. 2, further, a maintenance and recovery mechanism 56 is placed in a non-printing area situated on one side of the carriage 3 in the main scan direction to maintain and recover the operating state of the nozzles of the print heads 7.

The maintenance and recovery mechanism 56 includes caps 57, a wiper blade 58, and a waste droplet receiving part 59. The caps 57 serve to cap the respective nozzle faces of the print heads 7. The wiper blade 58 serves as a blade member to wipe the nozzle faces. The waste droplet receiving part receives droplets when droplets not used for printing are ejected for the purpose of ejecting print liquid having increased viscosity.

In the image forming apparatus having the configuration as described above, the paper sheets 12 are fed from the paper feeder unit one by one separately from one another. The paper sheets 12 traveling substantially in a vertical direction are then guided by the guide 15. Each paper sheet 12 is placed between the conveyer belt 21 and the counter roller 22 to be conveyed. A tip of each paper sheet 12 is guided by the conveyer guide 23 and urged by the roller 25 against the conveyer belt 21 so that the paper sheet tip's travel direction changes by approximately 90 degrees. At the same time, a control unit (not shown) uses an AC bias supply unit to apply an alternating voltage having alternating positive and negative voltages to the charge roller 26. Further, the conveyer belt 21 is charged by an alternating charge voltage pattern, in which plus charge and minus charge alternate with each other at predetermined intervals in the sub-scan direction that is equal to the rotation direction. When a paper sheet 12 is supplied to the conveyer belt 21 that is charged in this manner, the paper sheet 12 is stuck to the conveyer belt 21 through an electrostatic force, so that the paper sheet 12 is conveyed in the sub-scan direction by the rotation of the conveyer belt 21.

The print heads 7 are driven by image signals while the carriage 3 is moved back and forth. Ink droplets are thus sprayed onto the paper sheet 12 that is staying still to print an image for one line. The printing of the next line is performed after shifting the paper sheet 12 a predetermined distance. In response to a print completion signal or a signal indicative of the tail end of the paper sheet 12 reaching the print area, the print operation comes to an end, followed by discharging the paper sheet 12 to the paper discharge tray 54.

In the case of duplex printing, the conveyer belt 21 is rotated in a reverse direction after the printing of a first surface (i.e., the surface on which printing is performed first) comes to an end. The paper sheet 12 for which printing has been performed is thus fed into the duplex unit 61. The paper sheet 12 is then flipped over to show its second surface (i.e., back surface) as a print surface for provision to a gap between the counter roller 22 and the conveyer belt 21. The paper sheet is conveyed on the conveyer belt 21 in the same manner as previously described for printing on the back surface, followed by being ejected onto the paper discharge tray 54.

The carriage 3 is moved to the maintenance and recovery mechanism 56 during a standby period waiting for next printing. The caps 57 cap the nozzle faces of the print heads 7 to maintain the nozzles in a wet state, which prevents spray failure due to the drying of inks. Further, the print liquid is sucked from the nozzles while the caps 57 are kept in the capping position to cap the print heads 7, thereby performing a recovery operation to remove print liquid having increased viscosity and bubbles. The wiper blade 58 wipes the nozzle faces to remove the inks attached to the nozzle faces of the print heads 7 by the recovery operation. Further, a waste spray operation is performed to eject inks that are not used for a printing operation before the commencement of printing or during the printing operation. This maintains the stable spray performance of the print heads 7.

Figure 3:
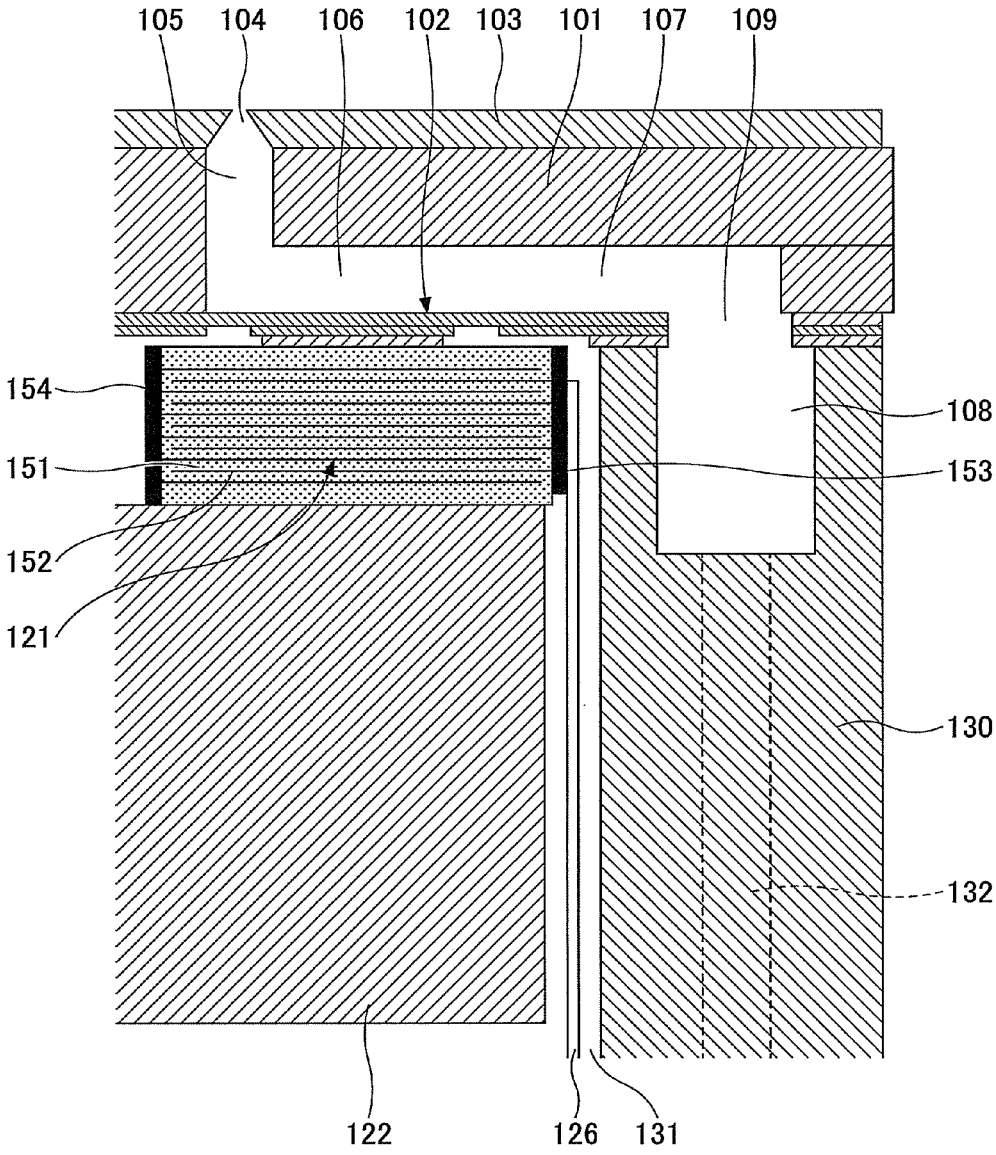
FIG. 3 is a cross-sectional view illustrating an example of a print head of the image forming apparatus.
Figure 4:
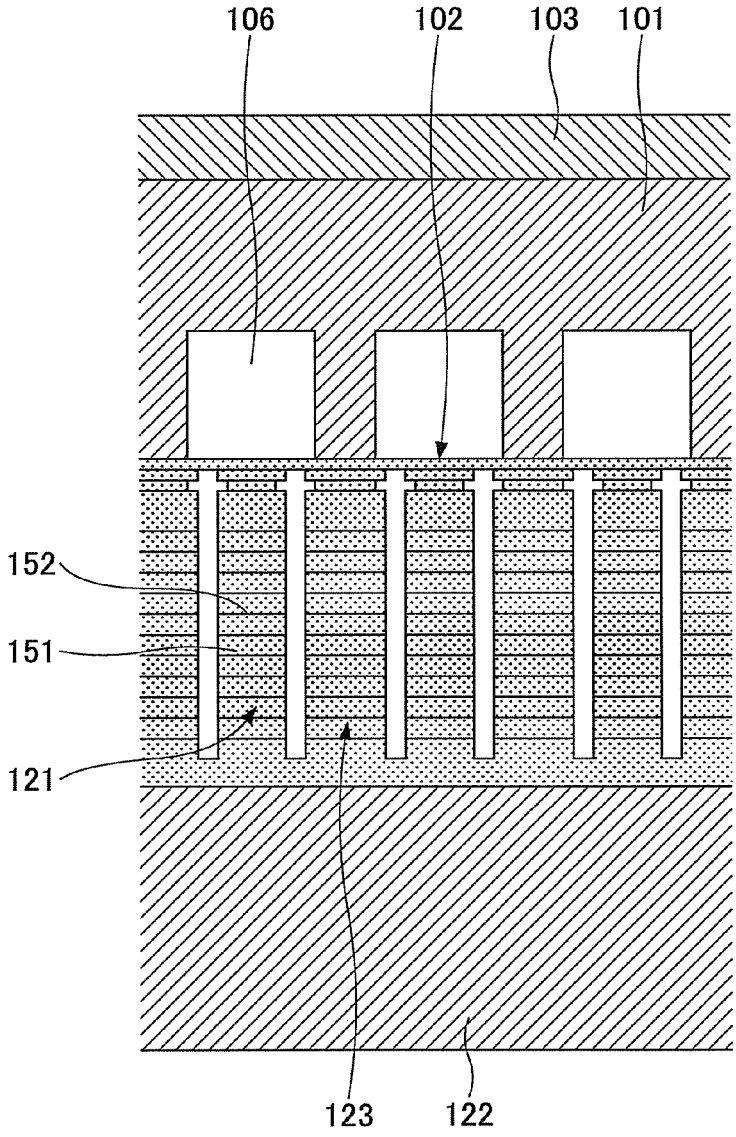
FIG. 4 is a cross-sectional view illustrating an example of the print head of the image forming apparatus.

In the following, an example of a liquid spray head for use as the print heads 7 will be described by referring to FIG. 3 and FIG. 4. FIG. 3 is a cross-sectional view of a liquid spray head taken along a longitudinal direction of a liquid chamber. FIG. 4 is a cross-sectional view of the liquid spray head taken along a traverse direction of liquid chambers (i.e., along a direction in which nozzles are arranged).

The liquid spray head includes a liquid conduit plate 101 formed by anisotropic etching of a single crystal silicon substrate, for example, a vibration plate 102 formed by nickel electrocasting, for example, and bonded to the lower surface of the liquid conduit plate 101, and a nozzle plate 103 bonded to the upper surface of the liquid conduit plate 101. In the liquid spray head, a nozzle communication conduit 105 communicating with a nozzle 104 that sprays liquid droplets (i.e., ink droplets) and a liquid chamber 106 serving as a pressure generating chamber are formed. Further, a ink supply port 109 communicating with a common liquid chamber 108 that supplies ink to the liquid chamber 106 through a liquid resistance part (supply conduit) 107 is also formed.

The liquid spray head further includes a layered piezoelectric element 121 and a base substrate 122 on which the piezoelectric element 121 is fixedly bonded. The piezoelectric element 121 has two lines, and serves as an electricity-to-mechanical-force converting element that is a pressure generating unit (i.e., actuator unit) to apply a pressure to the ink inside the liquid chamber 106 by deforming the vibration plate 102. Pillar portions 123 are disposed between the piezoelectric elements 121. The pillar portions 123 are formed together with the piezoelectric elements 121 by dividing a piezoelectric element member, and simply serve as supporting pillars since no drive voltage is applied thereto.

Moreover, an FPC cable 126 having a drive circuit (i.e., drive IC) implemented thereon is connected to the piezoelectric element 121.

The periphery of the vibration plate 102 is bonded to a frame member 130. The frame member 130 has a through-hole portion 131, a recess serving as the common liquid chamber 108, and an ink supply hole 132 to supply ink from an external source to the common liquid chamber 108. The through-hole portion 131 accommodates an actuator unit comprised of the piezoelectric element 121 and the base substrate 122. The frame member 130 is made of a thermosetting resin such as an epoxy-type resin or polyphenylene sulfide formed by injection molding.

The liquid conduit plate 101 is configured such that a recess and hole serving as the nozzle communication conduit 105 and the liquid chamber 106 are formed by anisotropic etching of a single crystal silicon substrate having a crystal orientation of (110), for example, by use of an alkali etching solution such as a potassium hydrate aqueous solution (KOH). It should be noted, however, that the material is not limited to a single crystal silicon substrate. Another material such as a stainless substrate or photosensitive resin may be used.

The vibration plate 102 is made of a nickel metal plate, which may be produced by electroforming (i.e., electrocasting). Alternatively, a plate made of another metal or a member comprised of a metal and a resin plate bonded together may be used. The piezoelectric elements 121 and the pillar portions 123 are bonded by an adhesive to the vibration plate 102, to which the frame member 130 is also bonded by an adhesive.

The nozzle plate 103 has a nozzle 104 with a diameter of 10 to 30 micrometers at the position of each liquid chamber 106, and is bonded by an adhesive to the liquid conduit plate 101. The nozzle plate 103 is configured such that a water repellant layer is formed as an outermost layer over the surface of a nozzle-formed member made of metal, with an intervening layer.

The piezoelectric element 121 is a layered piezoelectric element (e.g., PZT in this example) formed by stacking piezoelectric members 151 and inner electrodes 152 alternately in a multilayer structure. The inner electrodes 152 are alternately exposed on the opposite side faces for electrical coupling to an individual electrode 153 and a common electrode 154. In the present embodiment, ink inside the liquid chamber 106 is pressurized by use of a displacement in a d33 direction as a piezoelectric direction of the piezoelectric element 121. Alternatively, a displacement in a d31 direction as a piezoelectric direction of the piezoelectric element 121 may be used to apply a pressure to the ink inside the liquid chamber 106. Further, a line of piezoelectric elements 121 may be provided on a single base substrate 122.

In the liquid spray head having the configuration as described above, a voltage applied to the piezoelectric element 121 may be lowered from a reference potential to cause the piezoelectric element 121 to contract, thereby lowering the vibration plate 102 to expand the volume of the liquid chamber 106. In response, ink flows into the liquid chamber 106. The voltage applied to the piezoelectric element 121 is then raised to cause the piezoelectric element 121 to expand in a direction perpendicular to its layers, which causes the vibration plate 102 to shift toward the nozzle 104, thereby reducing the volume of the liquid chamber 106. This pressurizes the print liquid inside the liquid chamber 106, so that a droplet of the print liquid is sprayed (i.e., ejected) from the nozzle 104.

The voltage applied to the piezoelectric element 121 is then returned to the reference potential to restore the vibration plate 102 to its original position, which causes the liquid chamber 106 to expand to generate a negative pressure. Along with this movement, print liquid is replenished in the liquid chamber 106 from the common liquid chamber 108. An operation to spray a next droplet is commenced after the vibration of the meniscus face of the nozzle 104 sufficiently attenuates.

The method to drive the liquid spray head is not limited to the example described above in which pulling comes before a pushing ejection. A drive waveform may be changed to perform a pulling ejection or a pushing ejection.

Figure 5:
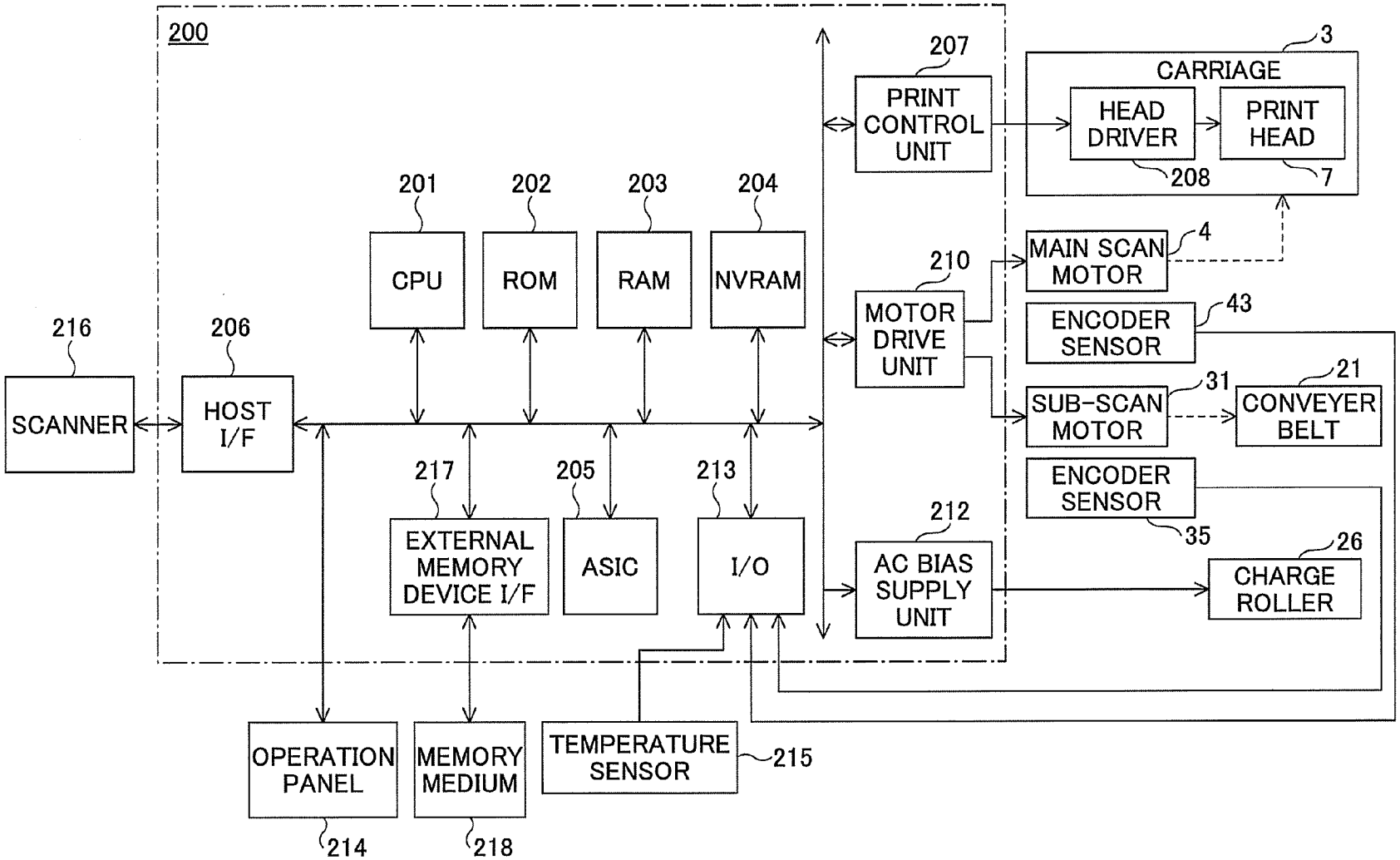
FIG. 5 is a block diagram illustrating an outline of a control unit of the image forming apparatus according to the embodiment.

In the following, a print control unit of the image forming apparatus will be described by referring to a block diagram illustrated in FIG. 5. FIG. 5 is a block diagram illustrating an outline of the control unit of the image forming apparatus. The control unit serves as a print control means.

A control unit 200 includes a CPU 201, a ROM 202, a RAM 203, a nonvolatile memory 204, and an ASIC 205. The CPU 201 attends to the overall control of the apparatus. The ROM 202 stores programs executed by the CPU 201 and other fixed data. The RAM 203 temporarily stores image data and the like. The nonvolatile memory 204 is a rewritable memory that retains data even during the time in which the power of the apparatus is turned off. The ASIC 205 performs various types of signal processing with respect to image data, image processing such as sorting, and other processing with respect to input/output signals for the purpose of controlling the entirety of the apparatus.

The control unit 200 includes a host I/F 206, a print control unit 207, a head driver (driver IC) 208, a motor drive unit 210, an AC bias supply unit 212, an I/O 213. The host I/F 206 serves to exchange data and signals with the host. The print control unit 207 includes a data transfer unit to drive and control the print heads 7 and a drive waveform generating unit to generate a drive waveform. The head driver 208 drives the print heads 7 disposed on the carriage 3. The motor drive unit 210 drives the main scan motor 4 and the sub-scan motor 31. The AC bias supply unit 212 supplies an AC bias to the charge roller 26. The I/O 213 serves to receive detection signals from the encoder sensors 43 and 35 and other detection signals from various sensors such as a temperature sensor that detects ambient temperature. The control unit 200 is connected to an operation panel 214 that is used to enter or display information necessary for the apparatus.

The control unit 200 receives image data or the like by use of the host I/F 206 via a cable or network from a host apparatus, which may be an information processing apparatus such as a personal computer, an image scan apparatus such as an image scanner 216, or an imaging apparatus such as digital camera.

The CPU 201 of the control unit 200 reads and analyzes print data stored in a receive buffer of the host I/F 206, and uses the host I/F 206 to perform required image processing, data sorting, or the like. The CPU 201 transfers the resultant image data through the print control unit 207 to the head driver 208. Dot pattern data generation for image outputting is performed by a printer driver provided in the host apparatus, as will be described later.

The print control unit 207 includes a drive waveform generating unit comprised of a D/A converter, a voltage amplifier, a current amplifier and the like, and further includes a waveform selecting unit to select a waveform for provision to the head driver 208. With this provision, the print control unit 207 transfers the image data to the head driver 208 as serial data, and outputs a transfer clock required to transfer the image data, a latch signal, a droplet control signal (i.e., mask signal) to the head driver 208. The D/A converter converts pattern data indicative of a drive signal stored in the ROM 202. The print control unit 207 generates a drive waveform comprised of a single drive pulse (i.e., drive signal) or a plurality of drive pulses (i.e., drive signals) for provision to the head driver 208.

Based on the serially-supplied image data for one line of the print heads 7, the head driver 208 selectively applies drive signals indicative of the drive waveforms supplied from the print control unit 207 to drive elements (e.g., piezoelectric element as previously described) to drive the print heads 7. The drive elements generate energy to cause the print heads 7 to spray droplets. In so doing, the drive pulses constituting the drive waveforms are selected to print dots of different sizes such as a large size dot (i.e., large size droplet), a middle size dot (i.e., middle size droplet), or a small size dot (i.e., small size droplet).

The CPU 201 computes a drive output value (i.e., control value) to be applied to the main scan motor 4 based on the detected speed value and detected position value obtained by sampling the detection pulses from the encoder sensor 43 forming a linear encoder and also based on the target speed value and target position value obtained from the speed and position profile registered in advance. The CPU 201 drives the main scan motor 4 via the motor drive unit 210. By the same token, the CPU 201 computes a drive output value (i.e., control value) to be applied to the sub-scan motor 31 based on the detected speed value and detected position value obtained by sampling the detection pulses from the encoder sensor 35 forming a rotary encoder and also based on the target speed value and target position value obtained from the speed and position profile registered in advance. The CPU 201 drives the sub-scan motor 31 via the motor drive unit 210.

An external memory device I/F 217 is an interface between the image forming apparatus and a memory medium 218 (e.g., flash memory) connected through a data transmission line such as a USB (Universal Serial Bus).

A predetermined program is stored in the memory medium 218. The program stored in the memory medium 218 is installed to the image forming apparatus via the external memory device I/F 217. The installed program is ready to be executed by the image forming apparatus.

<Functional Configuration>

Figure 6:
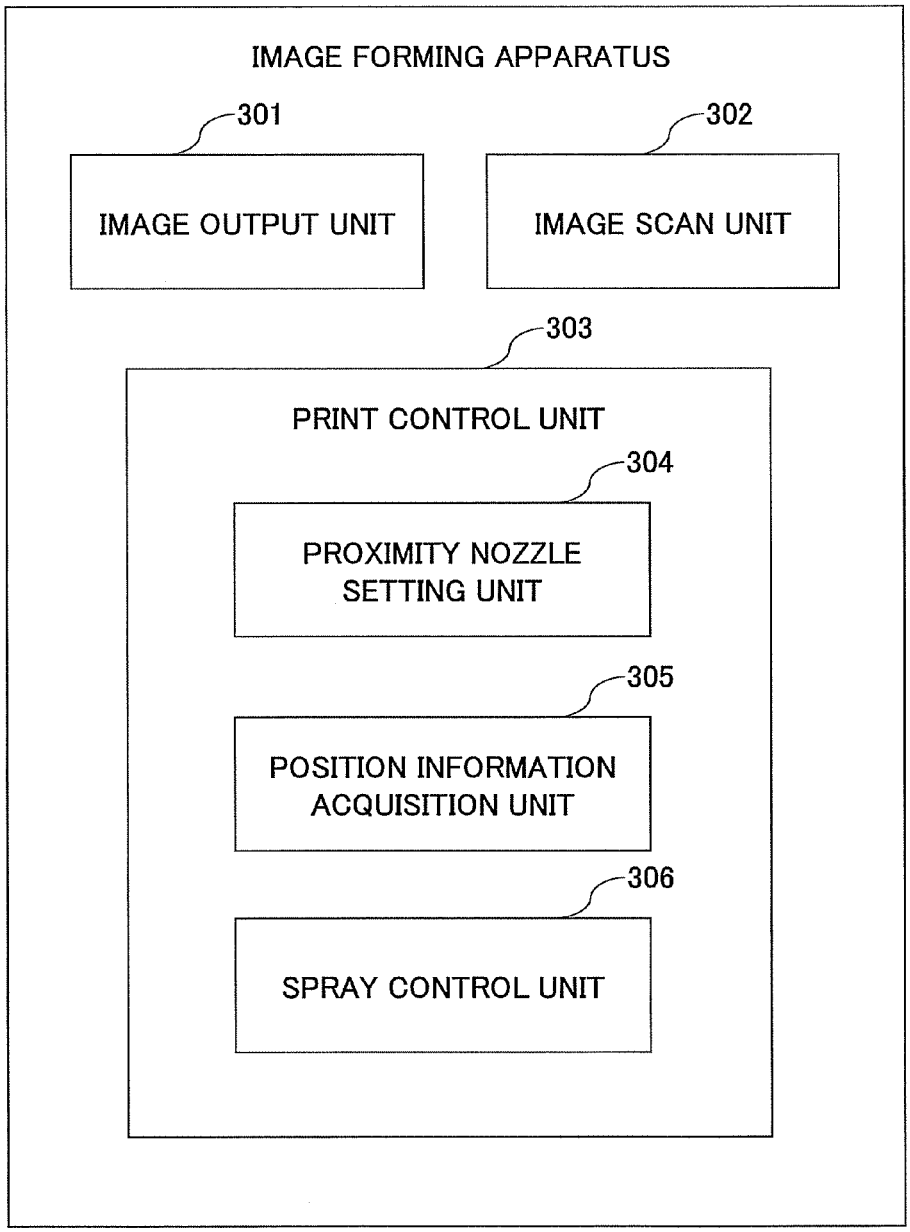
FIG. 6 is a block diagram illustrating an example of a main functional configuration of the image forming apparatus according to the embodiment.

In the following, the functional configuration of the image forming apparatus will be described. FIG. 6 is a block diagram illustrating an example of a main functional configuration of the image forming apparatus according to the first embodiment. As illustrated in FIG. 6, the image forming apparatus includes an image output unit 301, an image scan unit 302, and a print control unit 303.

Figure 15:
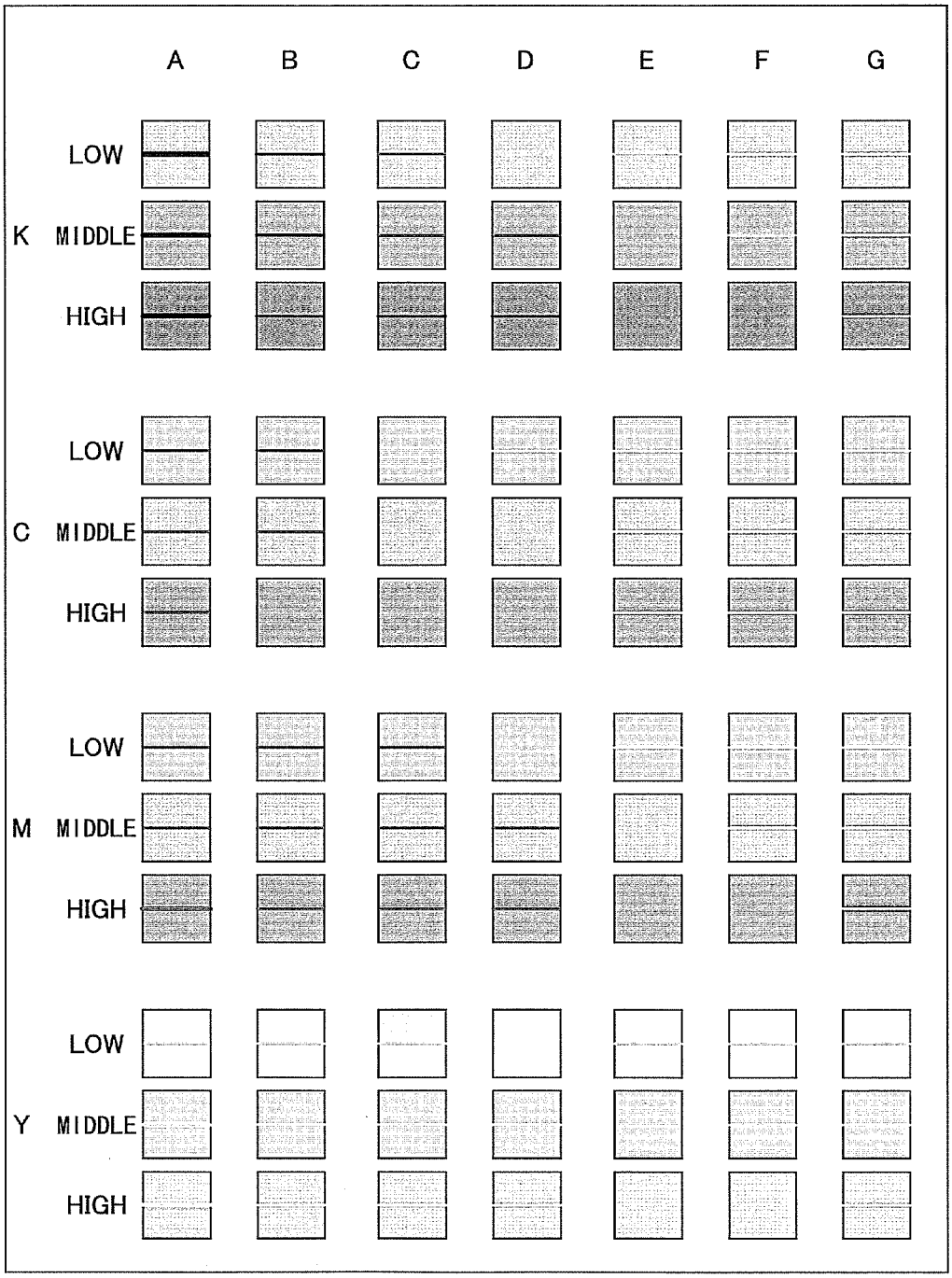
FIG. 15 is a drawing illustrating an example of a set of image patches printed around a seam line.

The image output unit 301 outputs an image as illustrated in FIG. 15, which will be described later. The image illustrated in FIG. 15 is used to detect the relative relationship between print head positions. The image scan unit 302 scans the image output by the image output unit 301.

The print control unit 303 includes a proximity nozzle setting unit 304, a position information acquisition unit 305, a spray control unit 306. The proximity nozzle setting unit 304 retains a setting registered in advance that specifies one or more nozzles (i.e., proximity nozzles) situated in a non-overlapping area in close proximity of the overlapping area.

A user selects one of the image patches illustrated in FIG. 15 that has the least conspicuous streaks, and enters information (i.e., positional relationship information) indicative of the selected image by use of the operation panel 214. The position information acquisition unit 305 acquires the positional relationship information selected by the user.

The images illustrated in FIG. 15 may be scanned by the image scan unit 302. In such a case, the position information acquisition unit 305 obtains density or luminance information to automatically select an image having the most improved streak problem (e.g., an image having the smallest luminance peak), thereby acquiring positional relationship information. In so doing, the position information acquisition unit 305 may preferentially select the positional relationship information selected by the user if such positional relationship information selected by the user is entered through the operation panel 214.

The spray control unit 306 controls the amount of ink sprayed by the proximity nozzles specified by the proximity nozzle setting unit 304 in response to one or more parameters such as ink spray amounts and/or resolution corresponding to the positional relationship information acquired by the position information acquisition unit 305. The detail of this ink spray control will be described later.

The position information acquisition unit 305 may be provided outside the print control unit 303. In this case, the print control unit 303 acquires parameters corresponding to the positional relationship information acquired by the position information acquisition unit 305.

<Serial Type>

In the following, a description will be given of a serial-type inkjet printer in which KCMY heads are connected in a longitudinal arrangement as the image forming apparatus of the first embodiment. In a serial-type inkjet printer, a print head having nozzles to spray ink is moved back and forth in a direction (i.e., main scan direction) perpendicular to a print sheet travel direction (i.e., sub-scan direction) to spray ink on a print sheet. Such spraying of ink is combined with the traveling of the print sheet to form an image on the print sheet.

Figure 7:
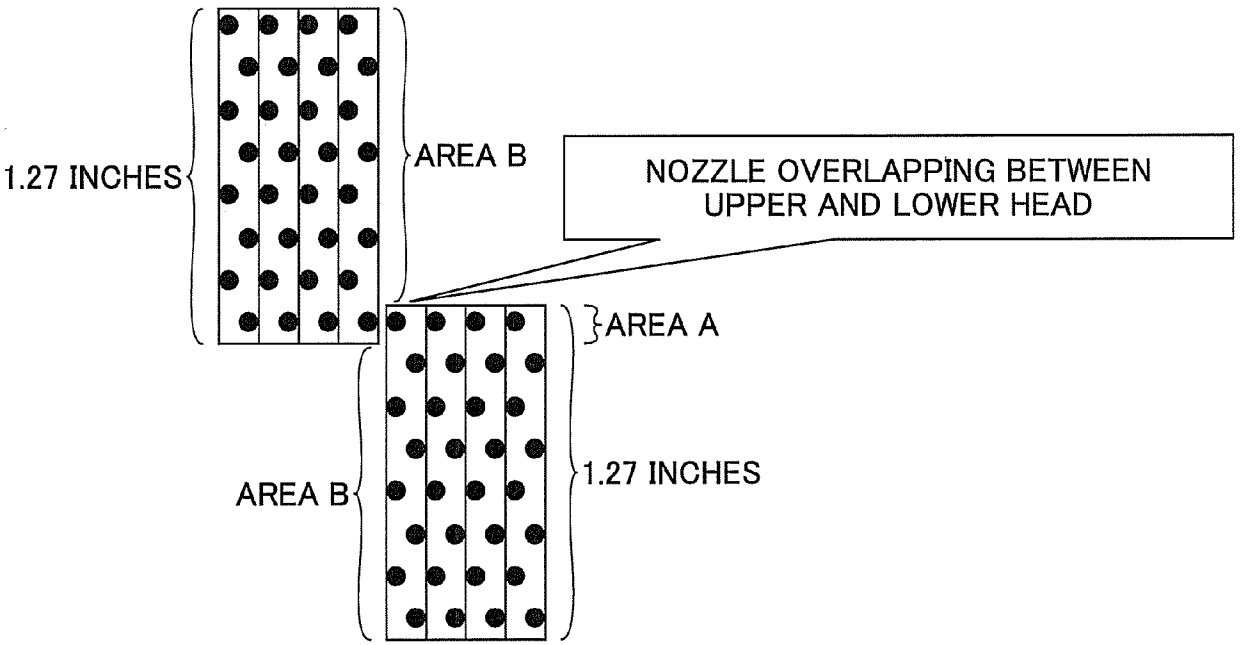
FIG. 7 is a drawing illustrating an example of a combined head.

FIG. 7 is a drawing illustrating an example of a combined head. As illustrated in FIG. 7, heads each having a length of 1.27 inches are connected in a direction of a nozzle line to form a combined print head (hereinafter referred to as a "combined head). Further, as illustrated in FIG. 7, the area where the upper and lower print heads overlap each other is referred to as an overlapping area (area A), and an area where the heads do not overlap is referred to as a non-overlapping area (area B).

In the image forming apparatus and image forming method disclosed herein, the phrase "overlapping area" may refer to the area where two or more nozzles are present for the general position of a single dot.

Figure 8A:
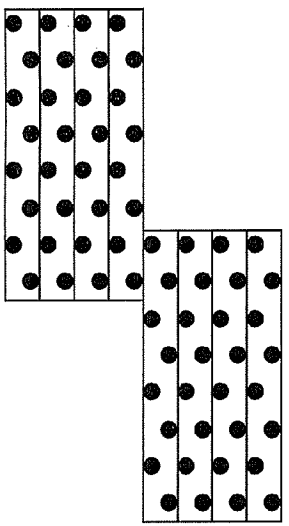
FIGS. 8A through 8D area drawings illustrating other examples of combined heads.
Figure 8B:
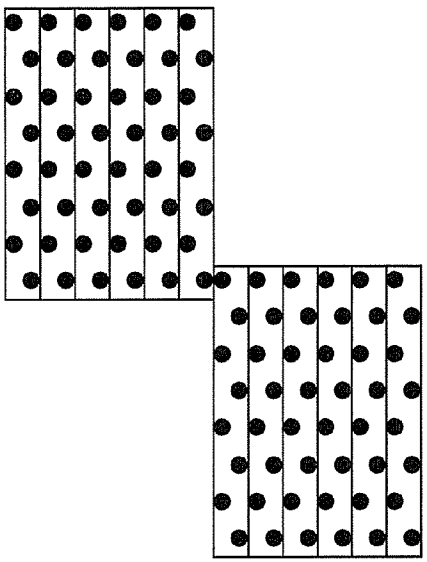
Figure 8C:
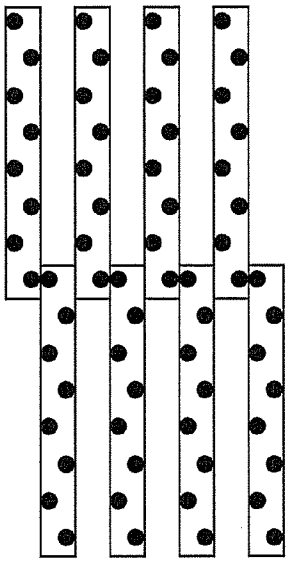
Figure 8D:
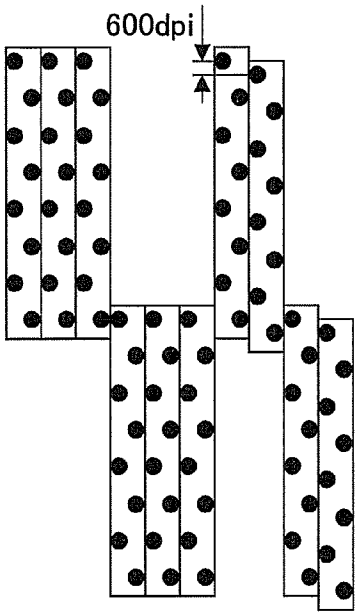

FIGS. 8A through 8D are drawings illustrating other examples of combined heads. As illustrated in FIGS. 8A through 8D, there are various ways to combine heads to form a combined head. FIG. 8A illustrates an example in which the number of overlapping nozzles is different from that of the example illustrated in FIG. 7. FIG. 8B illustrates an example in which the number of overlapping heads (i.e., number of colors) is different from that of the example illustrated in FIG. 7. FIG. 8C illustrates an example in which the way the upper and lower heads are connected is different from that of the example illustrated in FIG. 7. FIG. 8D illustrates an example in which resolution in the overlapping area is different from that of the example illustrated in FIG. 7.

What needs particular attention, however, may be the positions of generated dots around the junction point between heads. The number of overlapping nozzles, the number of colors, the arrangement of colors, the way the heads are connected, the density of nozzles, and so on are not limited to the examples illustrated in FIGS. 8A through 8D. In the following, for the sake of convenience of explanation, a description will be given of an example in which heads for a four-color configuration are connected in a longitudinal arrangement as illustrated in FIG. 7.

In the serial printer with the head configuration in which nozzles are connected as illustrated in FIG. 7, an image streak or uneven appearance may occur at the seam line between scan lines or at the seam line between the connected heads.

Figure 9A:
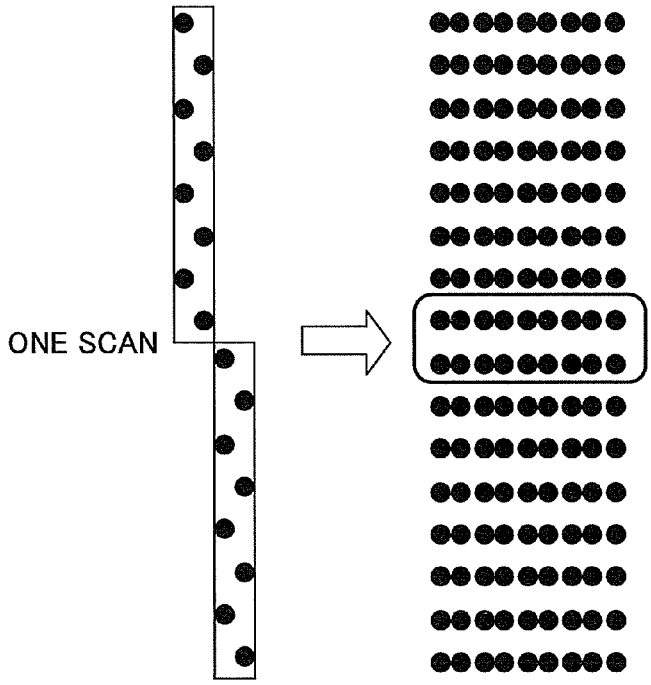
FIGS. 9A and 9B are drawings for illustrating a seam line.
Figure 9B:
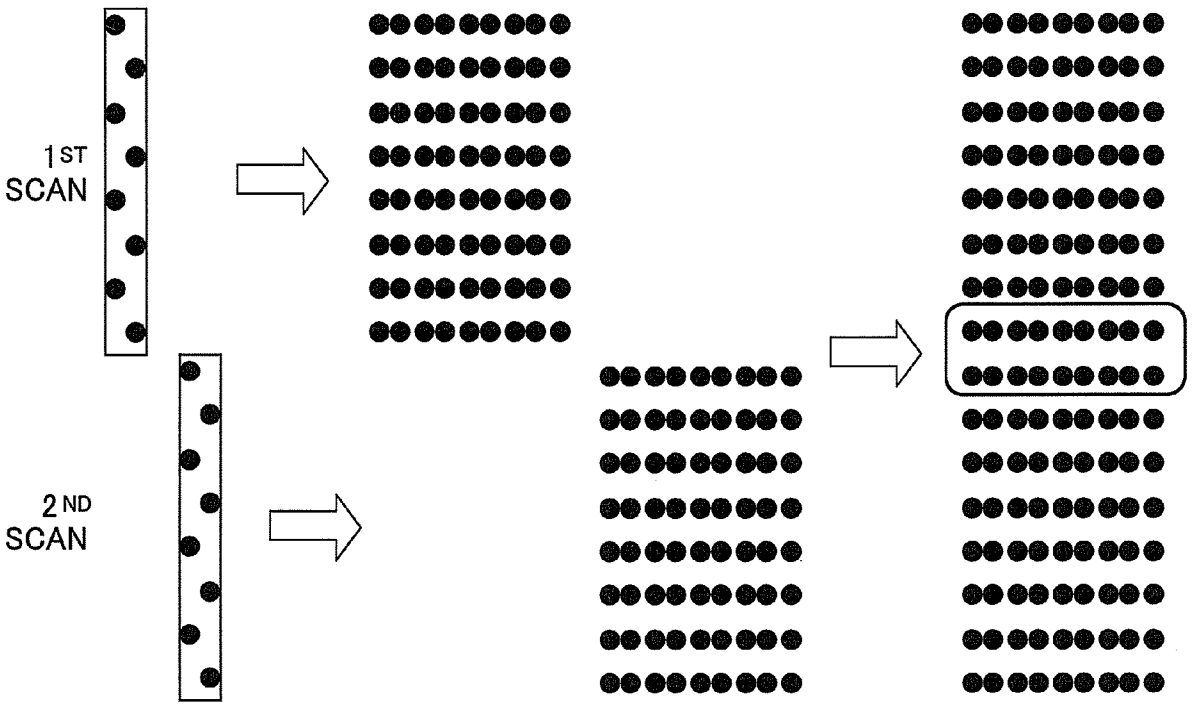

FIGS. 9A and 9B are drawings for illustrating a seam line. FIG. 9A is a drawing for illustrating a seam line between heads. As illustrated in FIG. 9A, a seam line between heads refers to a boundary between the physically adjacent heads of a combined head. FIG. 9B is a drawing for illustrating a seam line between scan lines. As illustrated in FIG. 9B, a seam line between scan lines refers to a boundary between an image area formed by a given scan and an image area formed by the next following scan performed after a carriage return.

The positions of printed dots may be displaced due to an error of the movement of a print sheet between the successive scans or due to the loosening of the assembled print heads. This causes a streak or uneven appearance to occur at the seam line due to variation in dot density. The seam line between scan lines is in existence not only in an image forming apparatus having a combined head, but also in an image forming apparatus that performs a scan operation in one way or another. Further, a streak or uneven appearance may occur even if only one head is existence, as long as scan operations are performed.

As previously described, a seam line between heads and a seam line between scan lines are substantially equal to each other in terms of their effect on the creation of a streak due to variation of dot density on a paper sheet. A seam line between heads and a seam line between scan lines will not be hereinafter discriminated from each other unless there is an explicit indication, and will be described simply as a seam line.

In the following, further, the two print heads as illustrated in FIG. 7 are used as an example. Nonetheless, a seam line in the following description may be a seam line between heads corresponding to a boundary between the heads of the combined head, or may be a seam line between scan lines corresponding to a boundary between a given scan line and a subsequent scan line.

Figure 10A:
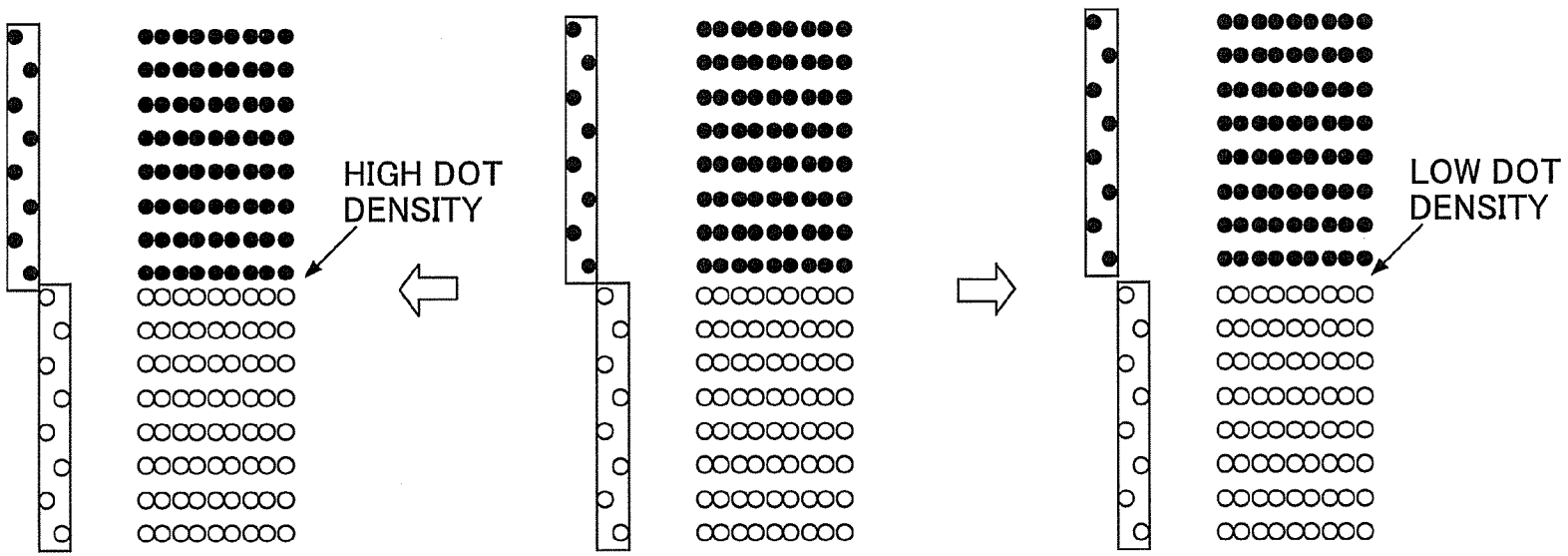
FIGS. 10A and 10B are drawings illustrating examples of streaks appearing at a seam line.
Figure 10B:
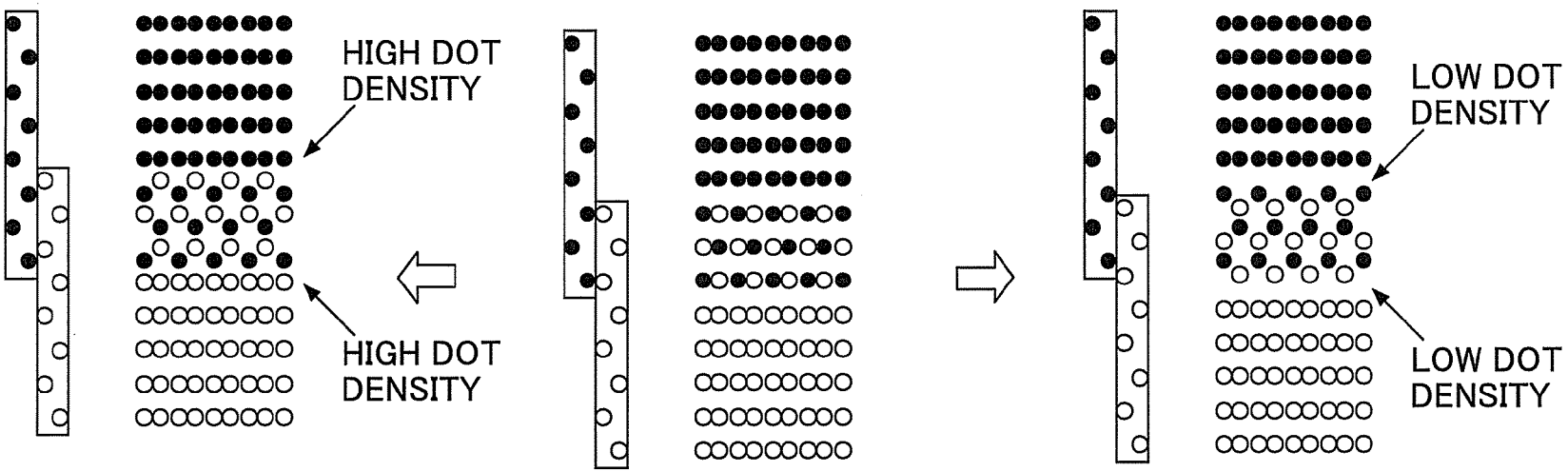

In the following, a description will be given of a streak appearing at a seam line. FIGS. 10A and 10B are drawings illustrating examples of streaks appearing at a seam line. A streak that appears in the case of no overlap processing will be first described by referring to FIG. 10A. As illustrated at the leftmost column in FIG. 10A, the dots adjacent to the seam line may be closer to each other than they are intended to be (i.e., print heads are brought closer to each other in the sub-scan direction), thereby creating a black streak due to an increased dot density at the seam line.

As illustrated at the rightmost column in FIG. 10A, the dots adjacent to the seam line may be farther apart from each other than they are intended to be (i.e., print heads are shifted farther away from each other in the sub-scan direction), thereby creating a white streak due to a decreased dot density at the seam line.

A black streak or white streak refers to a line of uneven image appearance caused by variation in dot density, and does not refer to a black color or white color. Regardless of whether a black ink or a cyan ink is used, a high-density streak appearing due to an increased dot density is referred to as a black streak, and a low-density streak appearing due to a decreased dot density is referred to as a white streak.

In the following, a streak that appears in the case of an existence of overlap processing will be described by referring to FIG. 10B. As illustrated at the leftmost column or the rightmost column in FIG. 10B, the positions of printed dots are dispersed, so that a contrast between the seam portion and the surrounding portions is blurred to lessen the appearance of a streak.

However, a difference in dot density may easily appear at the boundary between the overlapping portion and the non-overlapping portions. This gives rise to a problem in that a streak is likely to appear at the boundary. It should be noted that the number of overlapping nozzles and the pattern of dot distribution in the overlapping area are not limited to the examples illustrated in FIG. 10B.

According to the image forming apparatus of the first embodiment, the amount of sprayed ink is controlled for one or more raster lines (see FIGS. 11A and 11B) that are generated by one or more nozzles situated in the non-overlapping area in close proximity of the overlapping area. Such control improves the problem of streaks occurring at the boundaries between the overlapping area and the non-overlapping areas.

Figure 11A:
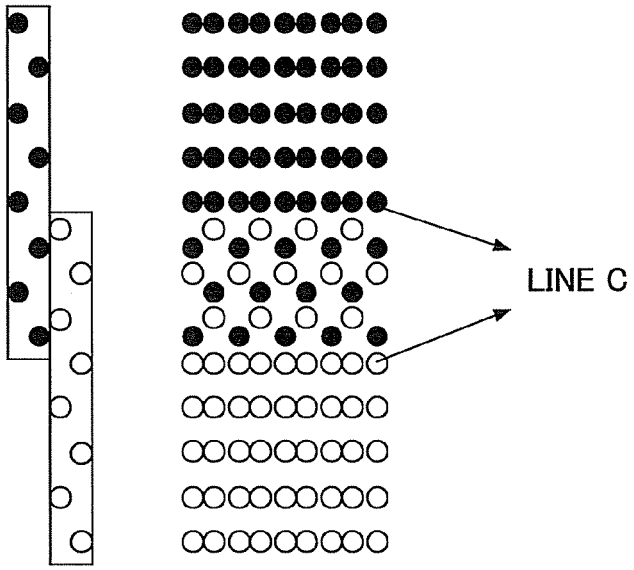
FIGS. 11A and 11B are drawings illustrating examples of nozzles for which the amount of sprayed ink is controlled.
Figure 11B:
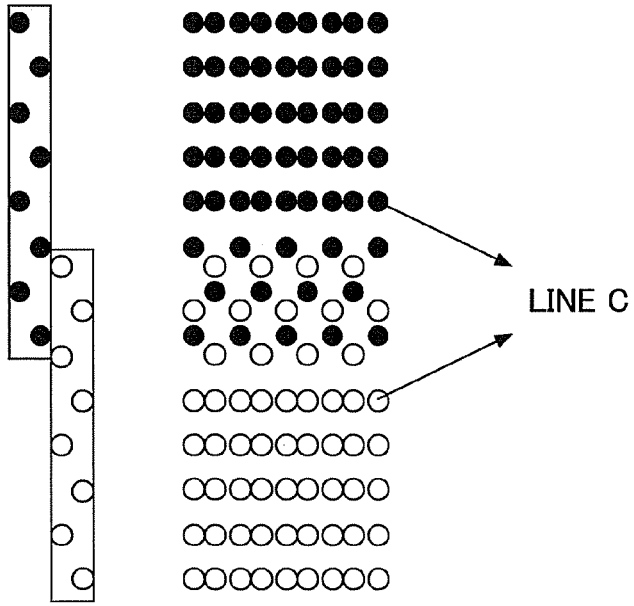

FIGS. 11A and 11B are drawings illustrating examples of nozzles for which the amount of sprayed ink is controlled. FIG. 11A is a drawing illustrating an example in which the print heads are brought closer to each other in the sub-scan direction. In the example illustrated in FIG. 11A, the dot density at the end of the print heads is increased. In this case, the amount of sprayed inks is controlled for the nozzles that print raster lines C, which are situated in close proximity to the overlapping area among the raster lines printed by the nozzles situated in the non-overlapping area. With this arrangement, the occurrence of a black streak is prevented at the boundaries between the overlapping area and the non-overlapping areas.

FIG. 11B is a drawing illustrating an example in which the print heads are shifted farther away from each other in the sub-scan direction. In the example illustrated in FIG. 11B, the dot density at the end of the print heads is decreased. In this case, the amount of sprayed inks is controlled for the nozzles that print raster lines C situated in close proximity to the overlapping area. With this arrangement, the occurrence of a white streak is prevented at the boundaries between the overlapping area and the non-overlapping areas. In the examples illustrated in FIGS. 11A and 11B, the amount of sprayed ink is controlled with respect to one raster line for one non-overlapping area. The amount of sprayed ink may not only be controlled with respect to this one raster line, but also be controlled with respect to any number of raster lines in close proximity of the overlapping area.

The method of controlling the amount of sprayed ink for dot printing includes a method of changing the number of dots and also a method of changing dot size. In order to decrease the amount of sprayed ink (i.e., in the case of lessening a black streak), printing may be performed by skipping dots that would originally be printed or by decreasing the size of printed dots to control the amount of sprayed ink. In order to increase the amount of sprayed ink, printing may be performed by forming corrective dots at positions that would not be originally printed to increase the number of dots or by increasing the size of dots to control the amount of sprayed ink.

Figure 12:
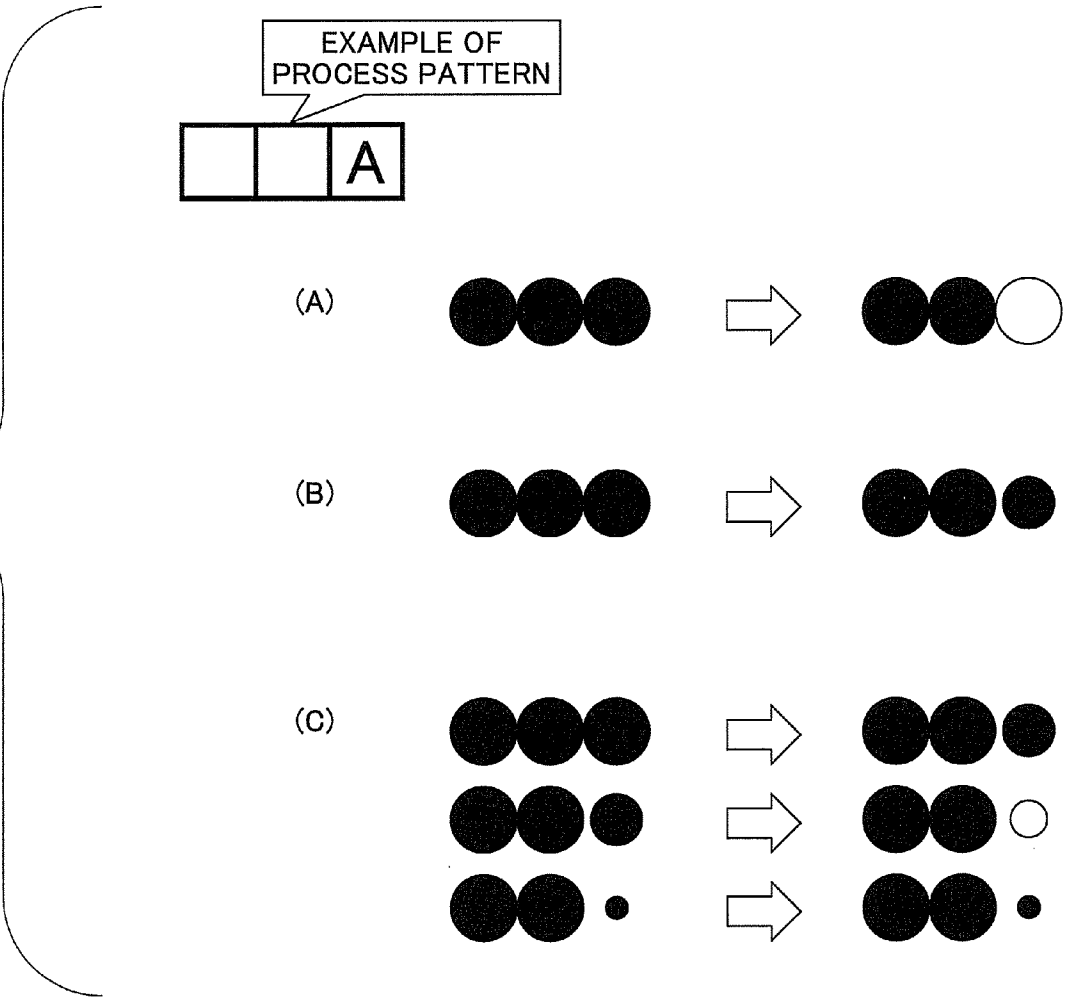
FIG. 12 is a drawing illustrating an example of a mask pattern.

The control of sprayed ink amount may be performed by assigning a process pattern to a raster line in the non-overlapping area. FIG. 12 is a drawing illustrating examples of mask patterns. As illustrated in FIG. 12, mask patterns that are prepared in advance may be assigned to raster lines in a non-overlapping area. When masking is performed by use of a mask pattern, masked bitmap data is printed by a print head. In the examples illustrated in FIG. 12, the amount of sprayed ink is controlled for a dot corresponding to the dot "A" appearing once in every three dots when printing a raster line in close proximity of the overlapping area.

As illustrated on a row (A) in FIG. 12, for example, a large droplet, a large droplet, and a large droplet may originally be assigned to three consecutive dots. In such a case, a dot may be skipped (i.e., the number of dots may be changed) after masking, such that a large droplet, a large droplet, and no droplet are assigned to the three consecutive dots. In another example illustrated on a row (B) in FIG. 12, a dot is not skipped, but the dot size is decreased (i.e., dot size change). A change in the number of dots and a change in the dot size may be combined. Further, the applied process may be changed depending on what the original dot is.

As illustrated on a row (C) in FIG. 12, for example, a dot may be changed to a middle-size droplet in the case of the original dot being a large droplet, may be skipped in the case of the original dot being a middle-size droplet, and may be retained as it is in the case of the original dot being a small droplet. What process is applied may be selected by a user.

The mask pattern illustrated in FIG. 12 is a simple pattern of 1×3. This is not a limiting example. The mask pattern may have a larger mask size or smaller mask size. Further, the position of a dot that is processed may be determined based on a randomly generated number in order to avoid processing at fixed intervals.

With the arrangement described above, variation in dot density is reduced at the boundaries between an overlapping area and non-overlapping areas. A streak appearing at the seam line between heads or at the seam line between scan lines is thus lessened.

The control of sprayed ink amount may be changed in response to input gray levels. Dot density is high for a high grayscale level, for example. Since a multi-value printer uses a large size dot in the case of a high gray scale, overlapping areas between dots are greater than in the case of a middle gray scale. A black streak is thus more likely to appear. Further, large overlapping areas between dots for a high grayscale level mean that a white streak is not likely to occur. Because of this, controlling the amount of sprayed ink in a uniform fashion may fail to sufficiently improve the problem of streaks, and even may cause other problems by performing excessive control.

Figure 13A:
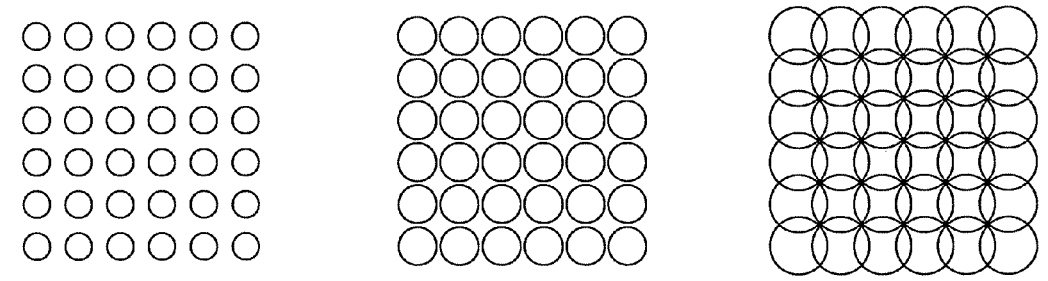
FIGS. 13A through 13C are drawings illustrating examples of differences in dot size depending on the differences in grayscale.
Figure 13B:
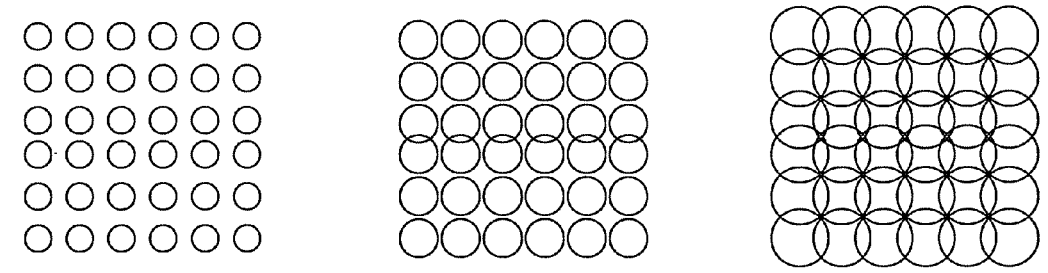
Figure 13C:
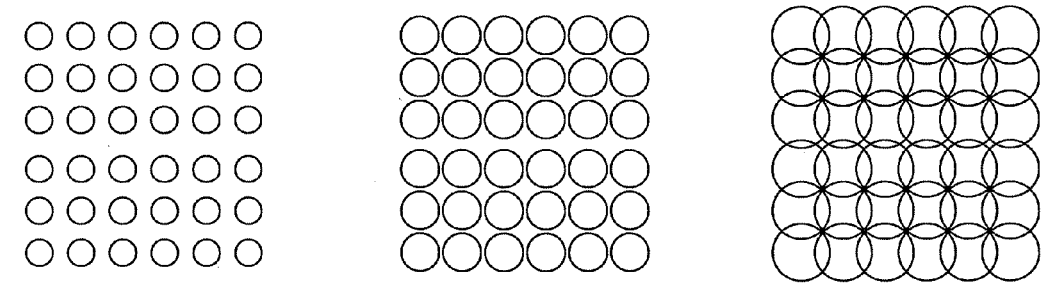

FIGS. 13A through 13C are drawings illustrating examples of differences in dot size depending on the differences in grayscale. FIG. 13A is a drawing illustrating examples of low-grayscale-level dots, middle-grayscale-level dots, and high-grayscale-level dots when there is no displacement. FIG. 13B is a drawing illustrating examples of low-grayscale-level dots, middle-grayscale-level dots, and high-grayscale-level dots when the dot sets on either side of the seam line are brought closer to each other in the sub-scan direction. As illustrated in FIG. 13B, no overlapping occurs in the case of the low grayscale level. On the other hand, overlapping occurs in the case of the middle grayscale level and the high grayscale level, thereby creating a situation in which a black streak is likely to occur. FIG. 13B is a drawing illustrating examples of low-grayscale-level dots, middle-grayscale-level dots, and high-grayscale-level dots when the dot sets on either side of the seam line are shifted farther away from each other in the sub-scan direction. As illustrated in FIG. 13C, no gap appears in the case of the high grayscale level. On the other hand, some gap appears in the case of the middle grayscale level and the low grayscale level, thereby creating a situation in which a white streak is likely to occur.

In consideration of the above, the amount of sprayed ink may preferably be controlled in response to an input grayscale level and a displacement at the seam line when printing dots from the nozzles that print dots around the seam line. In the case of a displacement that brings dots closer to each other at the seam line, the amount of sprayed ink is controlled by skipping dots and/or decreasing dot size around the seam line when the input grayscale level has a high to middle value. In the case of a displacement that shifts dots farther away from each other at the seam line, the amount of sprayed ink is controlled by increasing dot size, for example, around the seam line when the input grayscale level has a low to middle value. This arrangement properly lessens the appearance of a streak varying in response to a change in grayscale.

The control of sprayed ink amount may be changed in response to ink spray characteristics of an employed print head. Product variation of print heads causes each print head to have different ink spray characteristics even among the print heads that print the same color. A sprayed dot may have a different dot size depending on print heads. Identical processes applied to different heads may produce different outcomes even if the positional relationship between dots at the seam line is the same, resulting in a failure to reduce a streak, or resulting in another problem being created. Such problem may be the creation of a white streak caused by too much reduction in the amount of sprayed ink at a given seam line while the same ink reduction successfully removes a black streak in another seam line. It is thus preferable to check the ink spray characteristics of each print head and to apply the check results to the control of sprayed ink for each print head.

Further, the degree of conspicuousness of streaks and the degree of spreading of dots differ depending on individual colors. Even in the situation in which dots brought closer to each other across the seam line cause a black streak to appear in the same manner, the control of ink spray operations may be changed depending on print heads and colors (including taking into account the characteristics of inks such as colorants and pigments). For example, the amount of droplets may be significantly lowered for the black color, and may only be slightly lowered for the yellow color, thereby achieving processing that is suitable for each head.

Further, a dot size and the way a dot blurs differ depending on a paper sheet used for printing and also on an employed print mode. Accordingly, the control of sprayed ink may be changed in response to the type of a print sheet and a print mode that is employed. Namely, the degree of blurring of dots at the seam line is checked for each type of print sheet. The optimum amount of sprayed ink is then stored separately for each type of print sheet, thereby performing the control of sprayed ink in response to the type of the print sheet used. Further, the degree of blurring of dots at the seam line may be checked for each print mode such as a color print mode, a monochrome print mode, and a high-speed pint mode. The optimum amount of sprayed ink is then stored separately for each print mode, thereby performing the control of sprayed ink in response to the print mode used.

Moreover, the shape of sprayed dots may change depending on the environments in which the printer is used even when the same print heads and same colors are used. Viscosity of ink decreases at high temperature to enlarge dot size while dot size is small at low temperature. It is thus preferable to control the amount of sprayed ink in response to the ambient temperature around the print heads measured by a temperature sensor 215. In this manner, settings for raster line processing on the border of an overlapping area are changed to those suitable for the environment in which the print heads operate. This arrangement provides an image forming apparatus that is robust to changes in the environment while successfully preventing streaks and uneven appearance.

The optimum value used in the adjustment of ink spray amount differs depending on the relative relationship between nozzle positions across the seam portion. A small displacement in the relative nozzle positions means a small overlap or small gap between dots. In such a case, streaks are not so conspicuous that the amount of sprayed ink may be changed only by a small amount. On the other hand, a large displacement in the relative nozzle positions means a large overlap or large gap between dots. In such a case, the amount of sprayed ink may need to be changed by a large amount to improve the problem of streaks. Accordingly, it is preferable to control the amount of sprayed ink in response to a displacement size.

Figure 14:
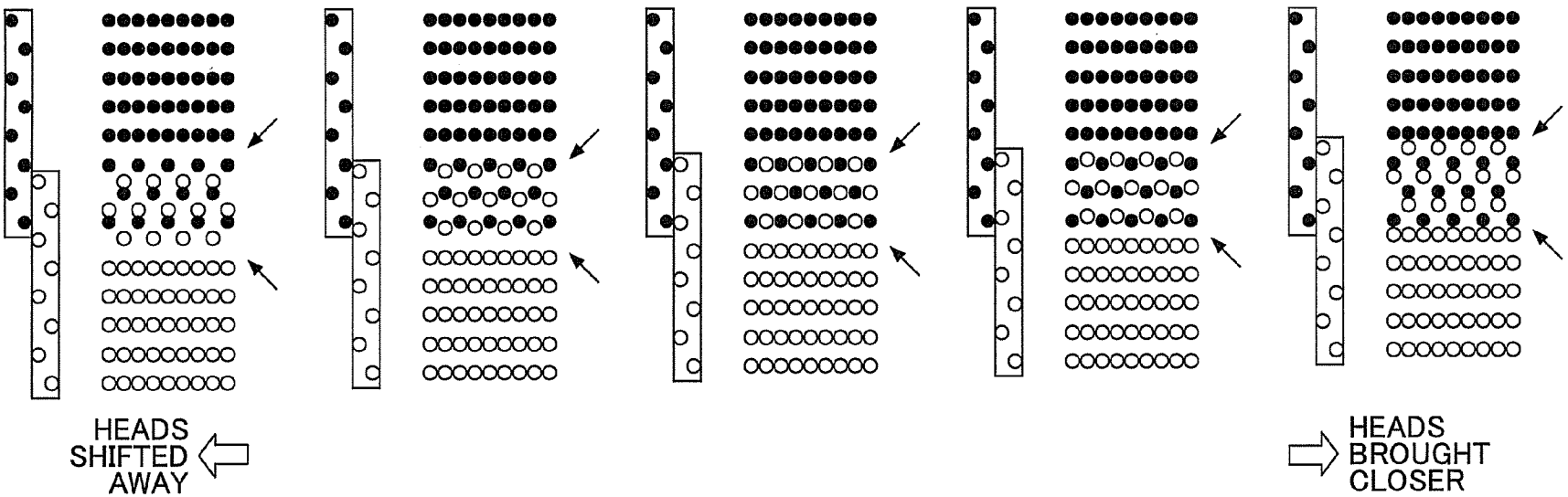
FIG. 14 is a drawing illustrating examples of different printed dot patterns caused by different displacements between print heads.

FIG. 14 is a drawing illustrating examples of different printed dot patterns caused by different displacements between print heads. As illustrated in FIG. 14, the distance between the print heads in the sub-scan direction increases towards the left in the figure, thereby increasing the gap at the portions indicated by arrows to exacerbate the problem of white streaks. As illustrated in FIG. 14, further, the distance between the print heads in the sub-scan direction decreases towards the right in the figure, thereby increasing the dot density at the portions indicated by the arrows to exacerbate the problem of black streaks.

Accordingly, dot size may be increased as the head distance increases, and may be decreased as the head distance decreases in the example illustrated in FIG. 14. This achieves proper control of sprayed ink.

In order to perform the control of sprayed ink that takes into account the state of print heads and relative positions between the print heads, an image patch to which plural parameters are assigned may be output for the seam portion. A user then selects the image that has the most preferable quality as free from streaks as possible, thereby choosing optimum parameters.

For example, an image to which plural parameters concerning elements such as grayscale levels and colors as previously described are assigned is produced for the seam portion. A user then selects the image in which streaks are least conspicuous. This makes it possible to select the optimum control of sprayed ink with respect to the respective elements such as a grayscale level, a color, a print head, a print sheet, a print mode, a nozzle displacement at the seam line, ambient temperature around the print heads, etc.

FIG. 15 is a drawing illustrating an example of a set of image patches printed around a seam line. As illustrated in FIG. 15, image patches are produced to be printed around a seam line. Columns A through G correspond to different settings for the control of sprayed dots. In this example illustrated in FIG. 15, the amount of sprayed ink decreases toward the right, and increases toward the left, with the column D indicative of the use of the middle amount.

Moreover, three different grayscale levels are provided for each of the KCMY colors in the example illustrated in FIG. 15. The image patch that has the least conspicuous streak is selected from the set of image patches illustrated in FIG. 15. The control of sprayed ink for raster lines in close proximity of the seam line is then determined by use of the parameters corresponding to the selected image patch. The images illustrated in FIG. 15 may be visually checked by a user of the image forming apparatus, with the results of the check being used as feedback information. Density or luminance information may be acquired by a sensor or scanner to automatically select an image having the most improved streak problem (e.g., an image having the smallest luminance peak), thereby setting the parameters for the control of the sprayed ink amount.

It is possible that dot positional precision around seam lines varies depending on positions on a print sheet. A decision made with respect to a given seam line may produce poor quality at a different seam line. The set of image patches described above may thus be printed at different positions on a print sheet. A user then selects an optimum image patch to achieve proper spray control from a viewpoint of a total balance on a print sheet. There may be a detectable tendency responsive to positions on a print sheet. In such a case, positions may be stored in memory, so that proper spray control tailored for individual positions may be performed.

With the configuration as described above, seam treatment is performed that takes into account the characteristics of various elements relating to an image forming apparatus such as grayscale levels, colors, print heads, print sheets, print modes, nozzle displacements at seam lines, temperature around the print heads, etc. Streaks and uneven appearance are thus effectively removed at seam lines between print heads as well as at seam lines between scan lines.

<Line Type>

In the following, a line-type inkjet printer will be described. The descriptions given heretofore have been provided with respect to a serial-type inkjet printer. Nonetheless, the technologies disclosed in these descriptions are also useful for a line-type inkjet printer.

As previously described, a line-type inkjet printer forms an image by use of a head unit that is fixedly mounted to extend substantially over the entire width of a print sheet. Due to this configuration, it is difficult to cope with the problem of streaks by a pass or interless technique. Moreover, it is difficult to produce a head extending over the entire width of a print sheet because of the limitations of a process of manufacturing a head and because of maintenance reasons.

Figure 16:
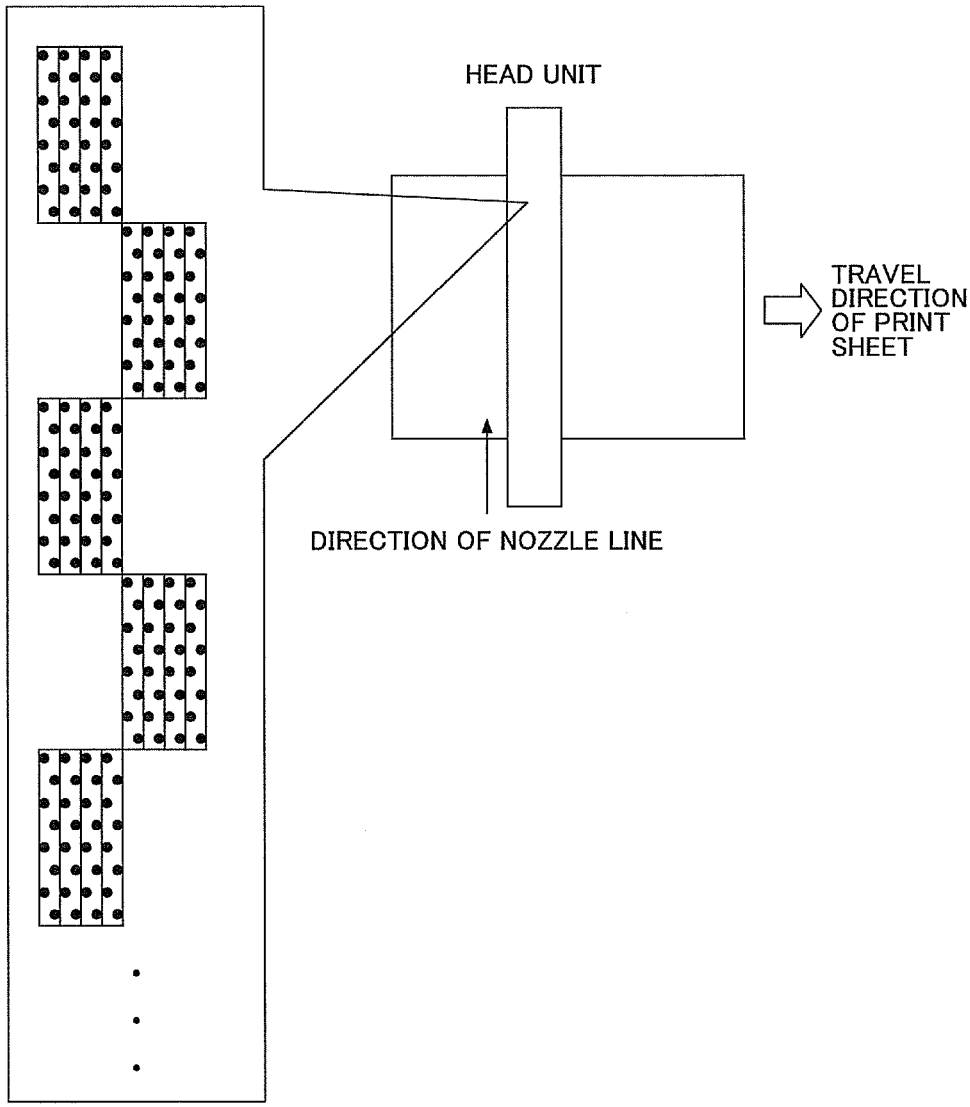
FIG. 16 is a drawing illustrating an example of an elongated head comprised of plural print heads connected together.

FIG. 16 is a drawing illustrating an example of an elongated head comprised of plural print heads connected together. As illustrated in FIG. 16, a line-type inkjet unit as typically used nowadays is an elongated head comprised of plural print heads connected together. The problem of streaks thus cannot be ignored when a line-type inkjet printer is used.

Figure 17:
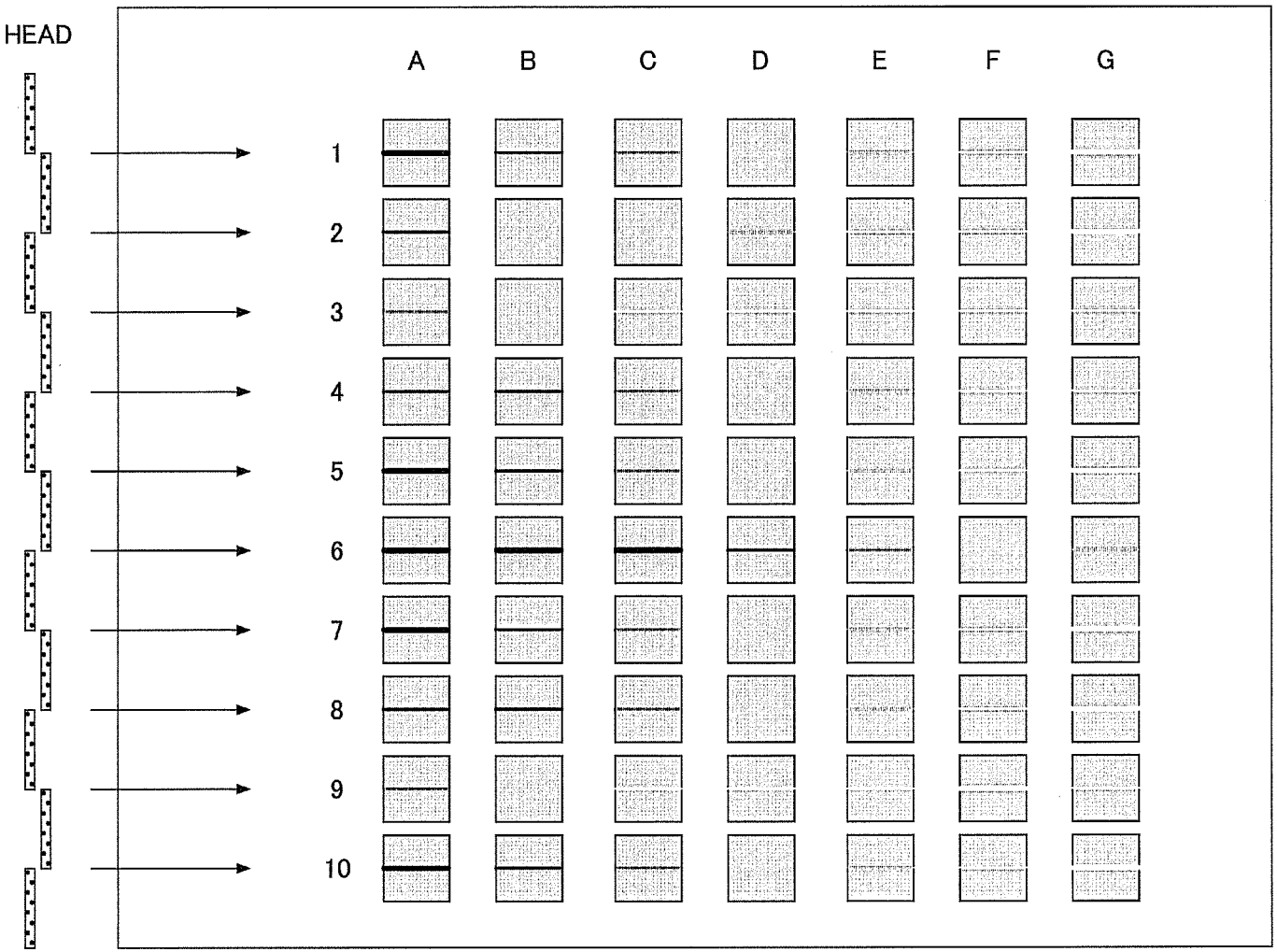
FIG. 17 is a drawing illustrating an example of a set of image patches that indicate the condition of streaks at seam lines of an elongated head.

In the following, a description will be given of a case in which the present invention is applied to a line-type inkjet printer. FIG. 17 is a drawing illustrating an example of a set of image patches that indicate the condition of streaks at seam lines of an elongated head. As illustrated in FIG. 17, image patches indicative of the conditions of streaks at seam lines between print heads are printed. These image patches are visually inspected by a user or scanned by a sensor or scanner for selection of a process (i.e., one of processes A through G) that has genteel density (or luminance) changes with less conspicuous streaks, thereby optimizing the control of sprayed ink at the seam lines.

In recent years, an increasing number of image forming apparatuses have been using replaceable print heads. With such a configuration in which replaceable print heads are used, the relative relationship between print head positions and the characteristics of the print heads may change due to the replacement work.

The arrangement for the control of spray operations as heretofore described can optimize spray control at seam lines not only right after the manufacturing of the image forming apparatus but also after the deterioration of components with age or after the replacement of components. This ensures that high-quality images free from streaks are produced.

<Operation>

In the following, the control of ink spraying in the first embodiment will be described. A serial-type image forming apparatus having a combined head is taken as an example, and a set of image patches as illustrated in FIG. 15 will be used. Operations described in the following is only a part of the operations of the image forming apparatus, and other operations as previously described may also be performed.

Figure 18:
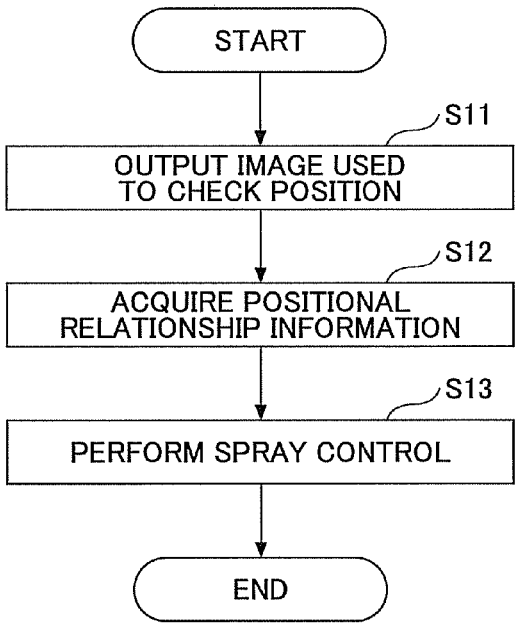
FIG. 18 is a flowchart showing the operations of the image forming apparatus according to the embodiment.

FIG. 18 is a flowchart showing the operations of the image forming apparatus according to the first embodiment. As illustrated in FIG. 18, in step S11, the image forming apparatus produces (i.e., prints) images (see FIG. 15) to be used for detection of relative positions of print heads.

In step S12, the print control unit 207 acquires information indicative of relative relationship between the print head positions (i.e., positional relationship information). The acquisition of such positional relationship information by the print control unit 207 may be achieved when a user selects an optimum image from the images as illustrated in FIG. 15 to enter a selected number (i.e., positional relationship information) through the operation panel 214 or the like. The print control unit 207 may use a sensor or the scanner 216 to scan the images illustrated in FIG. 15 to acquire density or luminance information to automatically select an image having the most improved streak problem (e.g., an image having the smallest luminance peak), thereby acquiring positional relationship information.

In step S13, the print control unit 207 controls the amount of ink sprayed from nozzles in response to the acquired positional relationship information. In so doing, the amount of sprayed ink is not controlled for all the nozzles of the print heads. Rather, the amount of sprayed ink is controlled only with respect to the nozzles of the combined head situated in the non-overlapping areas in close proximity of the overlapping areas. Dot size changes or skipping may be performed as part of the control of sprayed ink amount.

Figure 19:
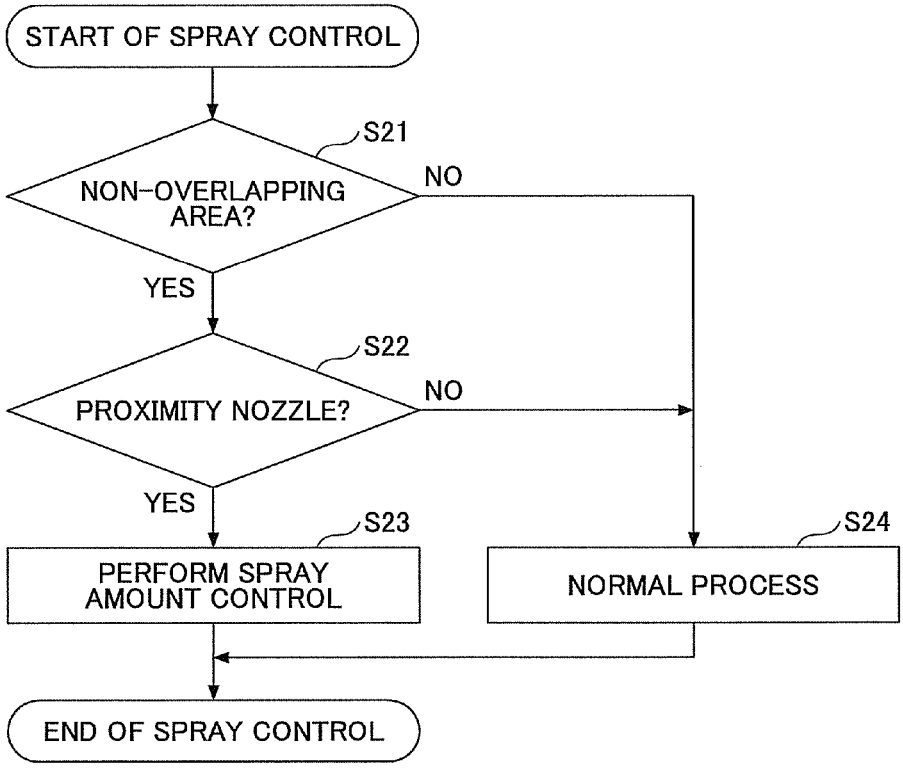
FIG. 19 is a flowchart illustrating an example of spray control.

In the following, spray control will be described. FIG. 19 is a flowchart illustrating an example of spray control.

In step S21, the print control unit 207 checks whether a nozzle to spray ink is situated in a non-overlapping area. If the check in step S21 indicates YES (i.e., the nozzle situated in a non-overlapping area), the procedure proceeds to step S22. If the check in step S21 indicates NO (i.e., the nozzle situated in an overlapping area), the procedure proceeds to step S24.

In step S22, the print control unit 207 checks whether the nozzle to spray ink is situated in close proximity of the overlapping area. Nozzles in one or more lines arranged in the sub-scan direction may be regarded as the nozzles in the close proximity of the overlapping area. If the check in step S22 indicates YES (i.e., the nozzle situated in the close proximity), the procedure proceeds to step S23. If the check in step S22 indicates NO (i.e., the nozzle situated outside the close proximity), the procedure proceeds to step S24.

The checks in steps S21 and S22 do not have to be made separately. Information indicative of proximity nozzles in the non-overlapping areas may be stored in advance in memory (e.g., ROM 202). The print control unit 207 may refer to the memory to identify the proximity nozzles situated in the non-overlapping areas. If the overlapping area is fixed, the nozzles to cover the seam portion are also fixed. In such a case, information indicative of nozzles in the seam portion and nozzles in the non-seam portions is stored in memory.

Provision may be made to adjust a variable overlapping area at the seam line between scan lines, for example. In such a case, the overlapping of heads may be computed based on the amount of line shift at carriage return. Parameters indicative of relationships between the amount of line shift and the number of nozzles in the seam portion may be stored in memory. With this arrangement, the print control unit 207 refers to the parameters stored in the memory to identify the number of nozzles corresponding to the amount of line shift, thereby identifying the proximity nozzles situated in the non-overlapping areas.

In step S23, the print control unit 207 controls the amount of ink sprayed from the proximity nozzles. The control of sprayed ink amount by the print control unit 207 may be achieved by changing dot size or changing the number of dots.

Specifically, the print control unit 207 reduces the amount of sprayed ink when a black streak (caused by high dot density) occurs, and increases the amount of sprayed ink when a white streak (caused by low dot density) occurs. A check as to the existence of a black or white streak is made by printing charts inclusive of patches (see FIG. 15, for example) for which the amount of sprayed ink varies and by letting a user visually inspect the chart images. In this case, the user makes a setting regarding the amount of sprayed ink through the operation panel based on the results of visual inspection. The chart images may be scanned by a scanner, so that the image forming apparatus determines the presence of a black or white streak based on the information indicative of density or luminance of the scanned images as previously described. In this case, the image forming apparatus automatically controls the amount of sprayed ink to achieve an optimum amount based on the results of determination.

Alternatively, all the heads of the combined head are used to print ruled lines or the like to let a user visually inspect the positional displacement of these heads based on the distances between the ruled lines. The amount of sprayed ink is then changed based on the results of visual inspection. The images having the ruled lines may be scanned by a scanner, so that the image forming apparatus automatically controls the amount of sprayed ink to achieve an optimum amount based on the information indicative of density or luminance of the scanned images. In such a case, the print control unit 207 reduces the amount of sprayed ink when the heads are closer than they should be (i.e., generating a black streak), and increases the amount of sprayed ink when the heads are farther away than they should be (i.e., generating a white streak).

In step S24, the print control unit 207 transmits signals to the head driver 208 to spray inks in a routine manner. It should be noted that the process in step S23 is performed for the proximity nozzles among the nozzles of the heads, and that the process in step S24 is performed for the remaining nozzles.

According to the first embodiment, ink spraying from nozzles printing one or more raster lines in close proximity of the overlapping area is controlled to remove streaks or the like occurring at the end of print heads having the overlapping area.

[Second Embodiment]

In the following, a description will be given of an image forming apparatus according to a second embodiment. In the second embodiment, either the use of both of the overlapping heads or the use of only one of the overlapping heads is made, depending on an image data object (hereinafter referred to simply as "object") formed by the overlapping area. This is because the jagged appearance becomes prominent due to the use of plural print heads depending on the types of objects printed in the overlapping area.

For example, the jagged appearance is pronounced especially for an object that is comprised of thin lines such as characters or lines. Such a jagged appearance ends up being enhanced when the amount of ink sprayed from nozzles in close proximity of the overlapping area is changed as described in the first embodiment.

Figure 20A:
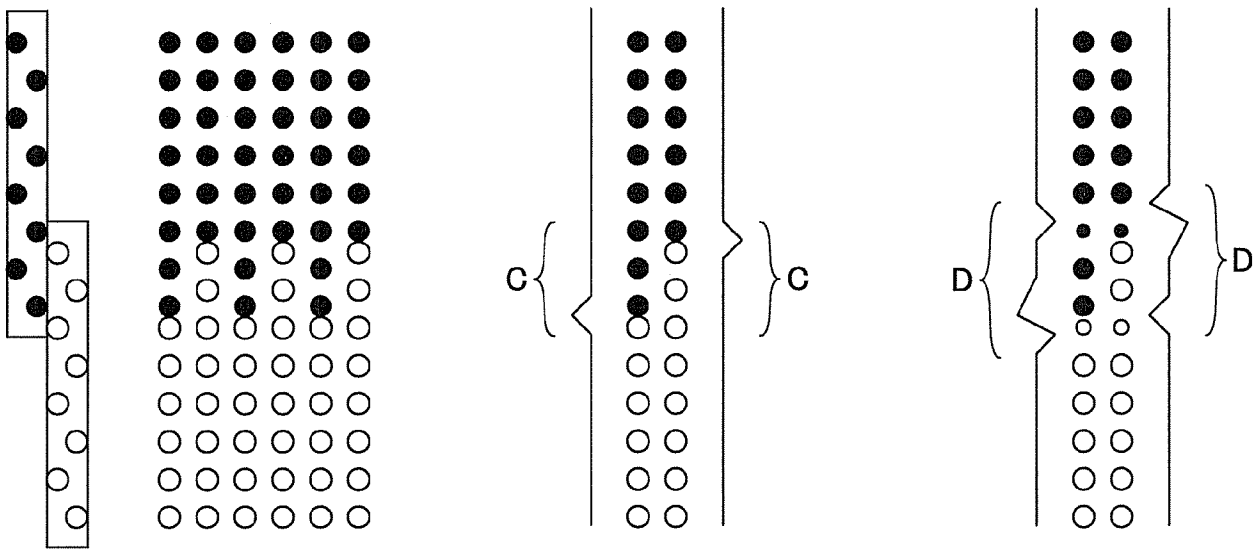
FIGS. 20A and 20B are drawings illustrating examples of enhanced jagged appearances of vertical lines.
Figure 20B:
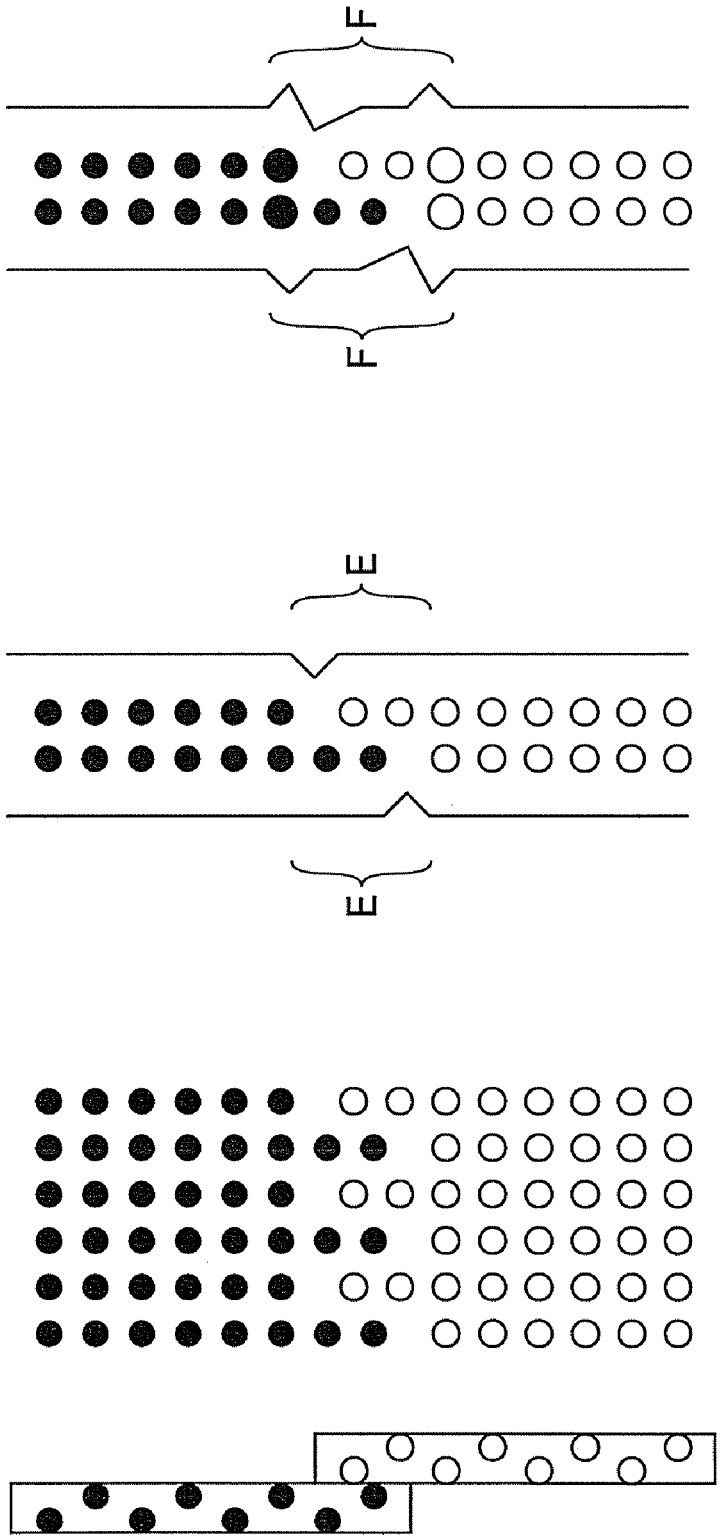

FIGS. 20A and 20B are drawings illustrating examples of enhanced jagged appearances of vertical lines. FIG. 20A illustrates a jagged appearance when the heads are brought closer to each other. A jagged appearance C occurs when the amount of sprayed ink is a normal amount. Such jaggedness is conspicuous when the object is a character or a thin line. A jagged appearance D occurs when the amount of ink sprayed from nozzles in close proximity of the overlapping area is changed, and is more enhanced than the jagged appearance C.

FIG. 20B illustrates a jagged appearance when the heads are shifted farther away from each other. As in FIG. 20A, a jagged appearance F in FIG. 20B occurs when the amount of ink sprayed from nozzles in close proximity of the overlapping area is changed, and is more enhanced than a jagged appearance E that is observed in the case of a normal amount of sprayed ink. Accordingly, it is preferable to avoid such an enhancement of jaggedness when the amount of ink sprayed from nozzles in close proximity of the overlapping area is changed.

<Functional Configuration>

Figure 21:
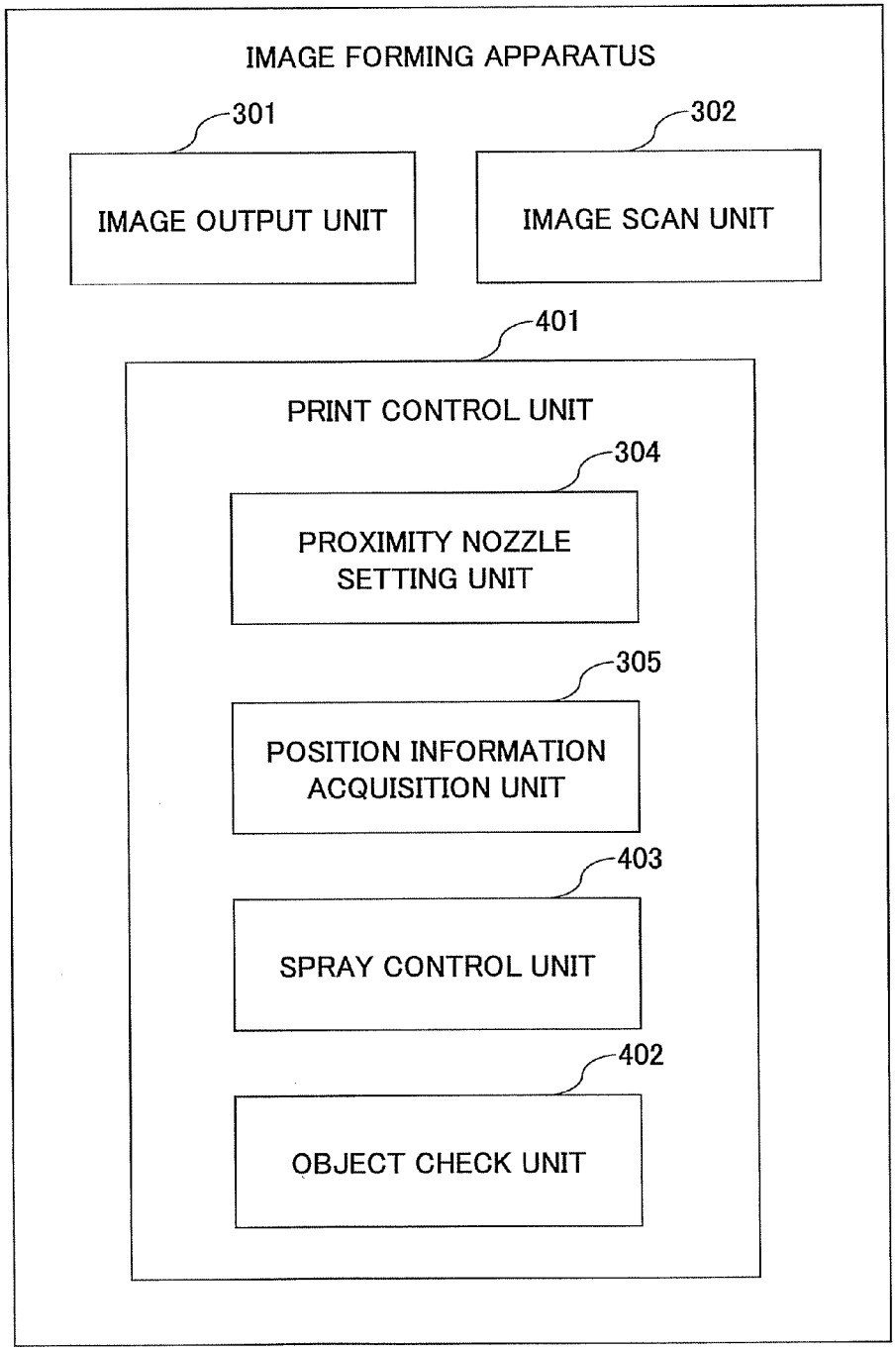
FIG. 21 is a block diagram illustrating an example of a main functional configuration of the image forming apparatus according to a second embodiment.

In the following, a description will be given of the functional configuration of the image forming apparatus according to the second embodiment. FIG. 21 is a block diagram illustrating an example of a main functional configuration of the image forming apparatus according to the second embodiment. As illustrated in FIG. 21, the image forming apparatus includes an image output unit 301, an image scan unit 302, and a print control unit 401. With respect to the functions illustrated in FIG. 21, the same or similar functions as those of FIG. 6 are referred to by the same numerals, and a description thereof will be omitted.

The print control unit 401 includes the proximity nozzle setting unit 304, the position information acquisition unit 305, a spray control unit 403, and an object check unit 402. In the following, the object check unit 402 and the spray control unit 403 will be described.

The object check unit 402 checks what the object printed in the overlapping area is. The check of an object made by the object check unit 402 may be based on either one of the following methods.

(1) Method Using Pattern Matching

The object check unit 402 identifies characters, fine lines, and the like by a pattern matching method. Characters and fine lines are registered in advance as specific patterns, and the object check unit 402 checks whether print data matches any of the specific patterns.

(2) Method Using RGB

The RGB values of print data for a given pixel may be all zero in the overlapping area. In such a case, the object check unit 402 determines that the print data at this pixel is an object comprised of thin lines such as a character or a thin line. Such a check is viable because pure black is likely to be used for characters and fine lines.

(3) Method Using Attribute Information

The object check unit 402 reads attribute information if the attribute information indicative of the specifics of an object is included in the print data supplied from a host apparatus (i.e., information processing apparatus). The object check unit 402 checks based on the attribute information whether the object is comprised of one or more thin lines such as a character or a thin line.

Based on the check made by use of one of the above-noted methods, the object check unit 402 may notify of the spray control unit 403 of the fact that the object printed by the overlapping area is comprised of one or more fine lines such as a character or a thin line. Moreover, the object check unit 402 may use one of the above-noted methods to check whether an object is an image or graphic.

The spray control unit 403 has the functions as described in the first embodiment. In addition, the spray control unit 403 controls a print operation in such a manner as to use only one of the overlapping print heads in response to the above-noted notice received from the object check unit 402. In the absence of the above-noted notice, the spray control unit 403 prints by using both of the overlapping print heads.

The control of ink spraying is the same as the one described in the first embodiment when both of the print heads are used. In the case of the use of only one of the print heads, however, the control of ink spraying described in the first embodiment is performed only with respect to the proximity nozzles situated near the end of the employed print head.

Moreover, the object check unit 402 may identify the object as being an image or graphic. In such a case, the spray control unit 403 may control printing such that both of the overlapping print heads are used in response to the notice indicative of an image or graphic from the object check unit 402.

Figure 22A:
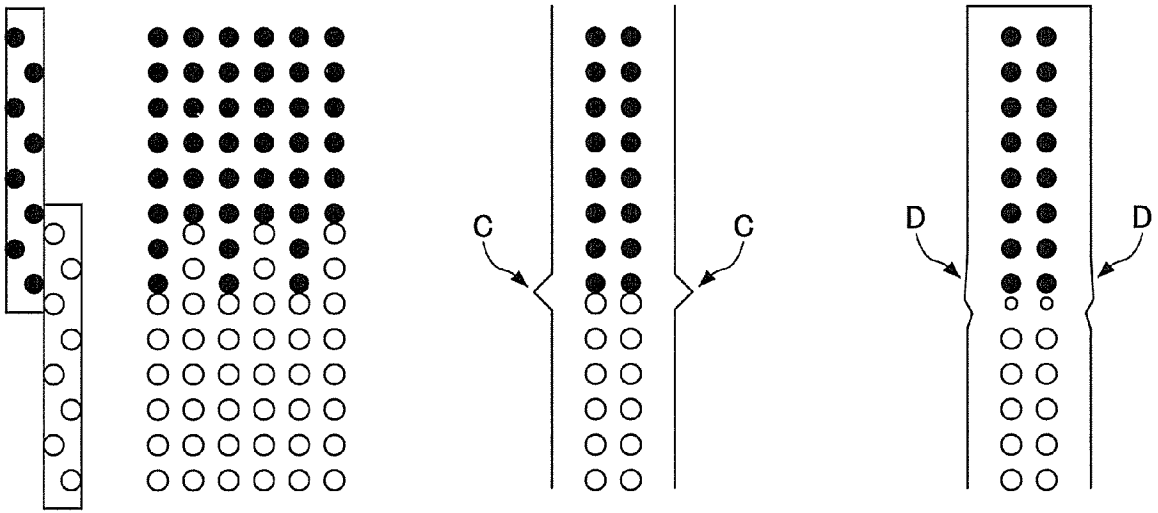
FIGS. 22A and 22B are drawings illustrating examples of lessened jagged appearances of vertical lines.
Figure 22B:
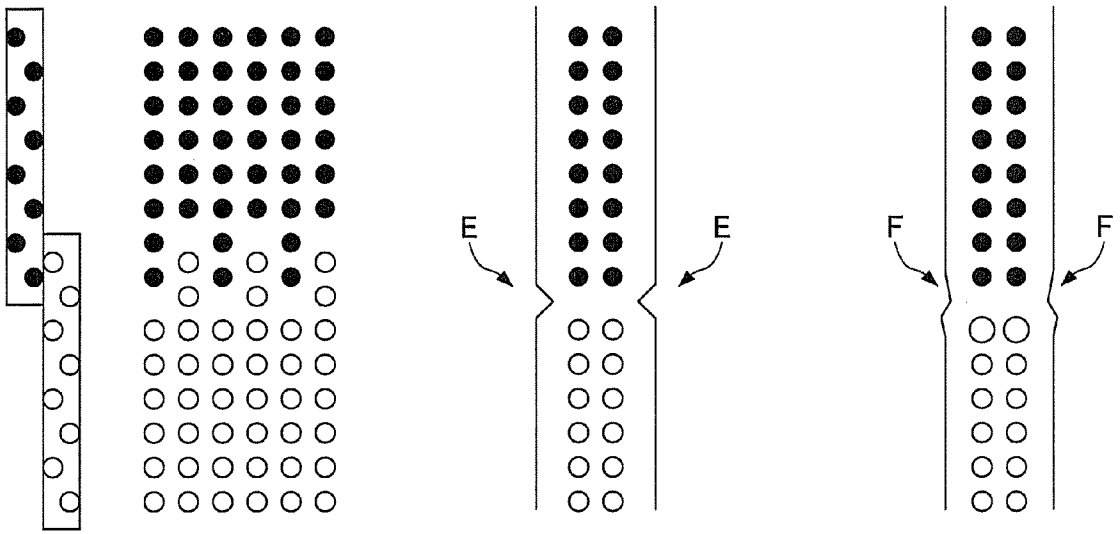

FIGS. 22A and 22B are drawings illustrating examples of lessened jagged appearances of vertical lines. FIG. 22A illustrates a jagged appearance when the heads are brought closer to each other. A jagged appearance C is observed when a normal amount of sprayed ink is used. When the object in the overlapping area is comprised of one or more fine lines such as a character or thin line, this object is printed by using either one of the overlapping print heads.

In the example illustrated in FIG. 22A, the upper one of the print heads is used to print the object in the overlapping area. A jagged appearance D occurs when the amount of ink sprayed from nozzles in close proximity of the overlapping area is changed, and is lessened more than the jagged appearance C or the jagged appearance D illustrated in FIG. 20A.

FIG. 22B illustrates a jagged appearance when the heads are shifted farther away from each other. A jagged appearance F illustrated in FIG. 22B occurs when the amount of ink sprayed from nozzles in close proximity of the overlapping area is changed. The jagged appearance F illustrated in FIG. 22B is lessened more than jagged appearance E obtained in the case of a normal amount of sprayed ink or the jagged appearance F illustrated in FIG. 20B.

The examples illustrated in FIGS. 20A and 20B and FIGS. 22A and 22B have been given with respect to a case in which the method described in the second embodiment is employed to lessen the jagged appearance of a thin vertical line. It should be noted, however, that the method described in the second embodiment is also applicable to a thin horizontal line as will be described in the following.

Figure 23A:
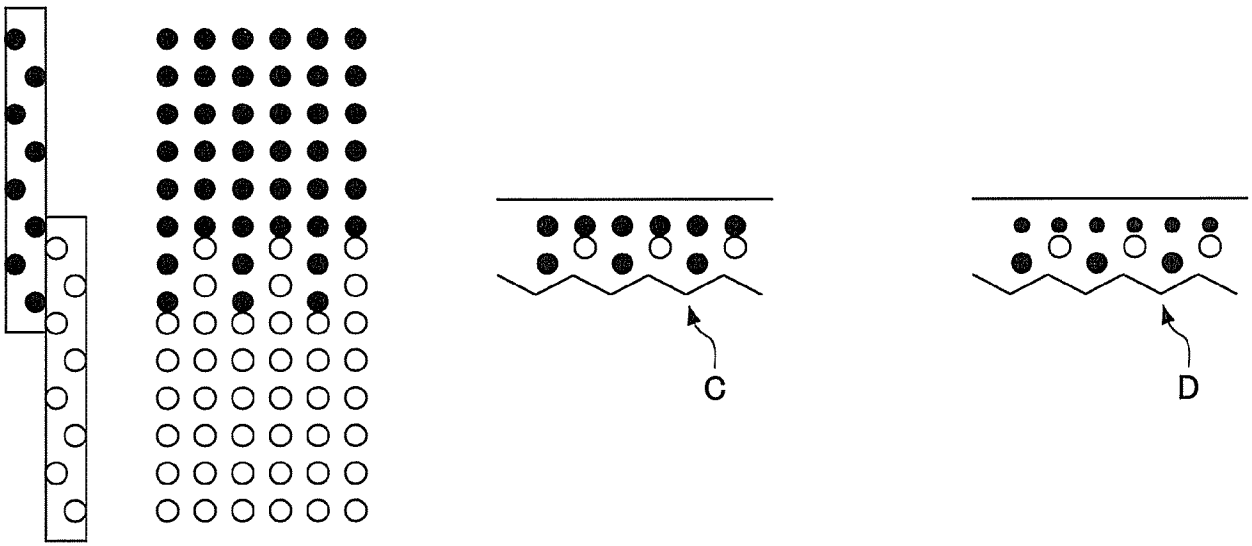
FIGS. 23A and 23B are drawings illustrating examples of enhanced jagged appearances of horizontal lines.
Figure 23B:
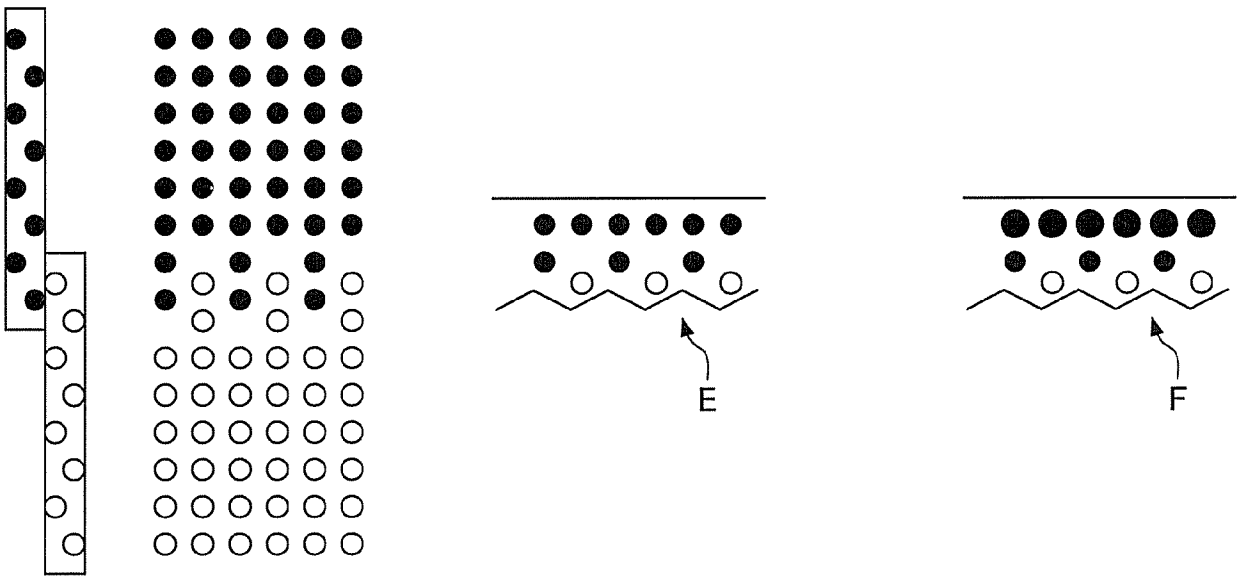

FIGS. 23A and 23B are drawings illustrating examples of enhanced jagged appearances of horizontal lines. FIG. 23A illustrates an example of jagged appearance when the heads are brought closer to each other. A jagged appearance C illustrated in FIG. 23A is observed when a normal amount of sprayed ink is used. A jagged appearance D illustrated in FIG.

23A occurs when the amount of ink sprayed from nozzles in close proximity of the overlapping area is changed.

FIG. 23B illustrates an example of a jagged appearance when the heads are shifted farther away from each other. A jagged appearance E illustrated in FIG. 23B is observed when a normal amount of sprayed ink is used. A jagged appearance F illustrated in FIG. 23B occurs when the amount of ink sprayed from nozzles in close proximity of the overlapping area is changed. As is demonstrated by the jagged appearances D and F illustrated in FIGS. 23A and 23B, the jaggedness of a horizontal line is not removed by changing the amount of ink sprayed from the proximity nozzles.

Figure 24A:
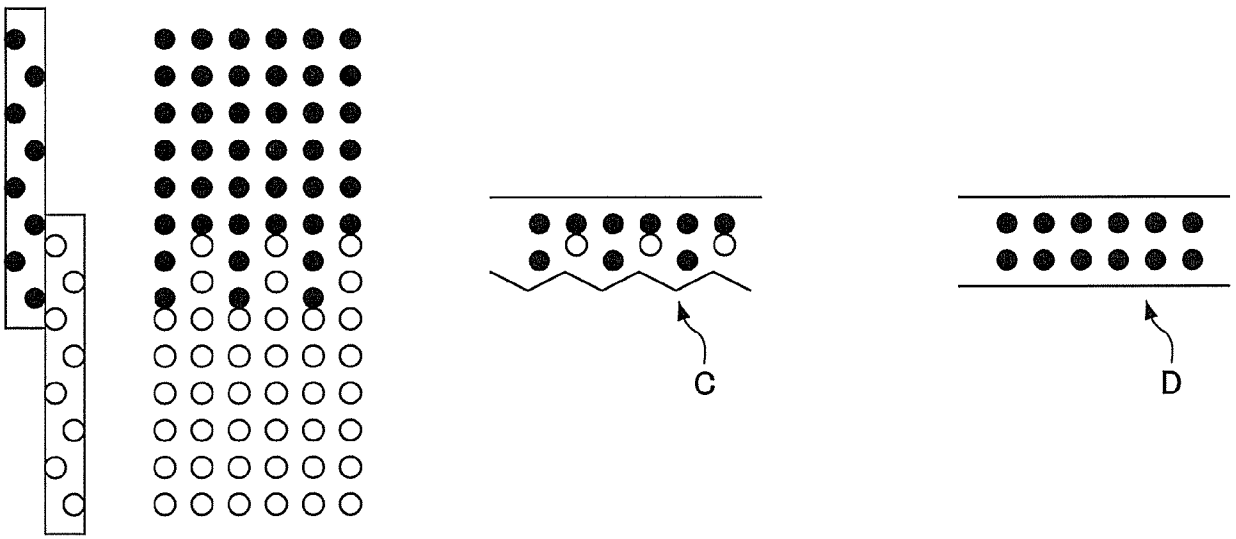
FIGS. 24A and 24B are drawings illustrating examples of removed jagged appearances of horizontal lines.
Figure 24B:
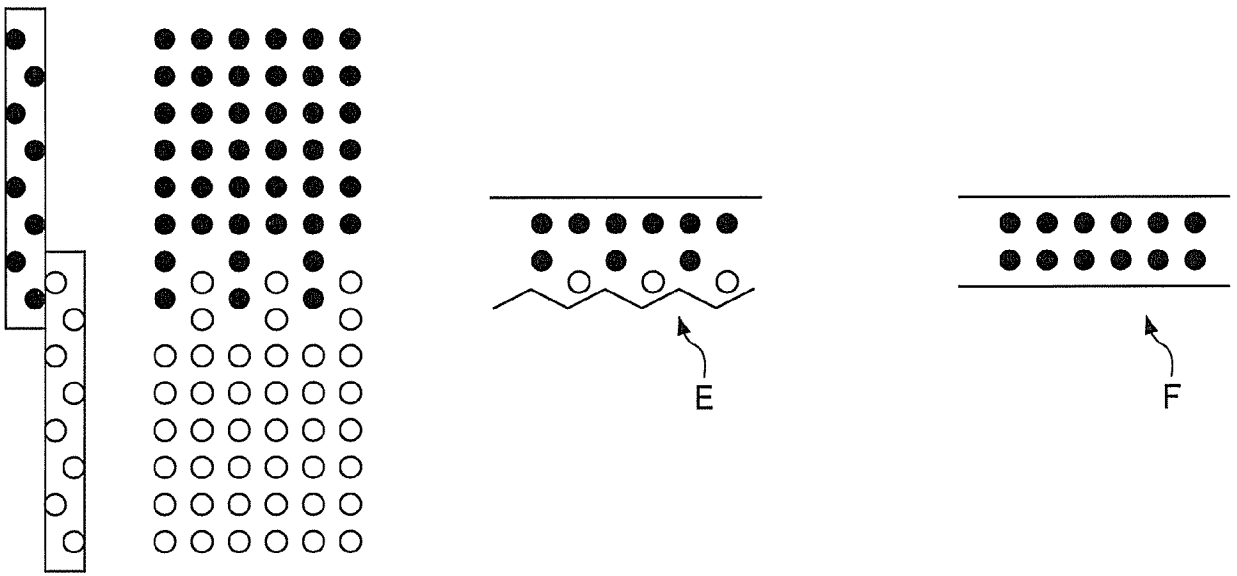

FIGS. 24A and 24B are drawings illustrating examples of removed jagged appearances of horizontal lines. FIG. 24A illustrates an example of a horizontal line when the heads are brought closer to each other. A jagged appearance C illustrated in FIG. 24A is identical to the jagged appearance C illustrated in FIG. 23A. A horizontal line D illustrated in FIG. 24A has no jaggedness. This is because an object in the overlapping area is printed by using either one of the overlapping print heads when the object is comprised of one or more fine lines such as a character or thin line. In the example illustrated in FIG. 24A, only the upper one of the print heads is used to print the object in the overlapping area.

FIG. 24B illustrates an example of a horizontal line when the heads are shifted farther away from each other. A jagged appearance E illustrated in FIG. 24B is identical to the jagged appearance E illustrated in FIG. 23B. A line F illustrated in FIG. 24B is printed by using only the upper one of the print heads in the overlapping area. In the case of the line F illustrated in FIG. 24B, the jagged appearance is removed from a horizontal line in the same manner as in the case of the line D illustrated in FIG. 24A by using only one of the print heads in the overlapping area.

According to the second embodiment described above, a streak and uneven appearance occurring at an end of a print head having an overlapping are is reduced. In addition, the jagged appearance is lessened or removed when the object printed in the overlapping area is comprised of one or more fine lines such as a character or a thin line.

In the embodiments disclosed heretofore, attention has been directed to a border of an overlapping area. This is because the problem of a streak occurs at an end of the overlapping area when a positional displacement occurs. This is attributable to the fact that dot variation is generated at the border between the overlapping area and a non-overlapping area. The amount of sprayed ink inside the overlapping area is not so different from the ink amount used outside the overlapping area, despite the fact that dot arrangement is different. A change in the amount of sprayed ink the control of sprayed ink amount) inside the overlapping area may cause additional uneven appearance of density.

In the following, a description will be given of an embodiment of a recording medium that stores a program and data used to perform image printing while performing the spray control described heretofore. Such a recording medium include a CD-ROM, a magnet-optical disk, a DVD-ROM, an FD, flash memory, a memory card, a memory stick, a ROM, a RAM, or the like. A program stored in such a recording medium is executed by a computer to implement the processes performed in the embodiments disclosed heretofore. The program to implement the processes of the image forming method and the functions of the image forming apparatus may be distributed in the form of a recording medium or by delivery through a network, thereby readily allowing the implementation of these processes and functions.

Further, the present invention is not limited to these embodiments, but various variations and modifications may be made without departing from the scope of the present invention.

Related-Art Documents

[Patent Document 1] Japanese Patent Application Publication No. 2007-015180

[Patent Document 2] Japanese Patent Application Publication No. 2005-169628

The present application is based on Japanese priority applications No. 2009-008049 filed on Jan. 16, 2009, No. 2009-096346 filed on Apr. 10, 2009, and No. 2009-265320 filed on Nov. 20, 2009, with the Japanese Patent Office, the entire contents of which are hereby incorporated by reference.

What is claimed is:

1. A method of forming an image by an image forming apparatus provided with a print head having plural nozzles, wherein the print head has an overlapping area whose print area overlaps a print area of a physically adjacent print head, or has an overlapping area whose print area overlaps an adjacent scan line on a print sheet surface, comprising:

an image forming step of forming an image by the print head, wherein the image forming step includes a control step of controlling in a variable manner an amount of ink sprayed only from a proximity nozzle situated outside the overlapping area in close proximity of the overlapping area, and the control step does not control an amount of ink sprayed from a nozzle situated inside the overlapping area.

2. The method as claimed in claim 1, wherein the control step changes a dot size generated by the proximity nozzle or a number of dots generated by the proximity nozzle in response to relative relationship between print head positions across the overlapping area.

3. The method as claimed in claim 2, wherein the control step decreases the dot size or the number of dots as a length of the overlapping area in a sub-scan direction increases, and increases the dot size or the number of dots as the length of the overlapping area in the sub-scan direction decreases.

4. The method as claimed in claim 1, wherein the control step controls the amount of ink sprayed from the proximity nozzle in response to a grayscale level of an image to be printed.

5. The method as claimed in claim 1, wherein the control step controls the amount of ink sprayed from the proximity nozzle in response to ink spray characteristics of the print head.

6. The method as claimed in claim 1, wherein the control step controls the amount of ink sprayed from the proximity nozzle in response to a print mode or a type of a print sheet on which an image is formed.

7. The method as claimed in claim 1, wherein the control step controls the amount of ink sprayed from the proximity nozzle in response to ambient temperature around the print head.

8. The method as claimed in claim 1, wherein the control step controls the amount of ink sprayed from the proximity nozzle in response to a mask pattern used to mask a raster line generated by the proximity nozzle.

9. The method as claimed in claim 1, wherein the image forming step switches, in response to a type of an image data object formed by the overlapping area, between use of only one print head and use of two print heads to form the image data object.

10. A computer-readable recording medium having a program recorded therein for causing a computer to perform the method of forming an image as set forth in claim 1.

11. The method as claimed in claim 1, wherein the method further comprises forming an image patch of the overlapping area and the proximity thereof, said image patch being formed based on a different value for each of a plurality of parameters, and determining an optimum value for each of the parameters.

12. An image forming apparatus, comprising:

a print head having plural nozzles, wherein the print head has an overlapping area whose print area overlaps a print area of a physically adjacent print head, or has an overlapping area whose print area overlaps an adjacent scan line on a print sheet surface; and a control unit configured to control in a variable manner an amount of ink sprayed only from a proximity nozzle situated outside of the overlapping area in close proximity of the overlapping area, wherein the control unit is configured not to control an amount of ink sprayed from a nozzle in the overlapping area.

13. The image forming apparatus as claimed in claim 12, further comprising:

an output unit configured to output an image used to detect relative relationship between print head positions across the overlapping area; and an acquisition unit configured to acquire positional relationship information indicative of the relative relationship, wherein the control unit is configured to control the amount of ink sprayed from the proximity nozzle in response to the positional relationship information acquired by the acquisition unit.

14. The image forming apparatus as claimed in claim 13, further comprising a scan unit configured to scan the image output by the output unit, wherein the acquisition unit is configured to acquire the positional relationship information from the image scanned by the scan unit.

* * * * *